US006477236B1

(12) United States Patent
Anno et al.

(10) Patent No.: US 6,477,236 B1
(45) Date of Patent: Nov. 5, 2002

(54) X-RAY TUBE OF ROTARY ANODE TYPE

(75) Inventors: Hidero Anno, Otawara (JP); Yukinari Yoshida, Nasu-gun (JP); Hironori Nakamuta, Otawara (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 43 days.

(21) Appl. No.: 09/690,448

(22) Filed: Oct. 18, 2000

(30) Foreign Application Priority Data

Oct. 18, 1999 (JP) ..... 11-295357
Oct. 18, 1999 (JP) ..... 11-295358
Apr. 28, 2000 (JP) ..... 2000-130911

(51) Int. Cl.[7] ..... H01J 35/10
(52) U.S. Cl. ..... 378/144; 378/127; 378/130
(58) Field of Search ..... 378/130, 132, 378/133, 200, 125, 127, 128, 144, 131

(56) References Cited

U.S. PATENT DOCUMENTS 5,091,927 A 2/1992 Golitzer et al. ..... 378/130
5,541,975 A * 7/1996 Anderson et al. ..... 378/130

FOREIGN PATENT DOCUMENTS

JP 62-140661 9/1987
JP 7-130311 5/1995

* cited by examiner

*Primary Examiner*—Robert H. Kim
*Assistant Examiner*—George Wang
(74) *Attorney, Agent, or Firm*—Pillsbury Winthrop LLP

(57) ABSTRACT

A rotary anode X-ray tube, comprising a rotor, a stationary structure, a dynamic pressure slide bearing formed between the rotor and the stationary structure, the stationary structure having a lubricant storage chamber and provided with a lubricant passageway, and a vacuum vessel. Holes are formed in the stationary structure extending from the lower edge surface along the tube axis and not to cross the lubricant storage chamber and the lubricant passageway. Heat transfer members for the stationary structure having a heat conductivity higher than that of the stationary structure are inserted into the holes, respectively. A heat transfer member having a heat conductivity higher than that of the inner cylindrical structure of the rotor is bonded in a cylindrical form to the outer circumferential wall of the inner cylindrical structure constituting a bearing. A heat transfer member can be mounted to each of the rotor and the stationary structure.

15 Claims, 17 Drawing Sheets

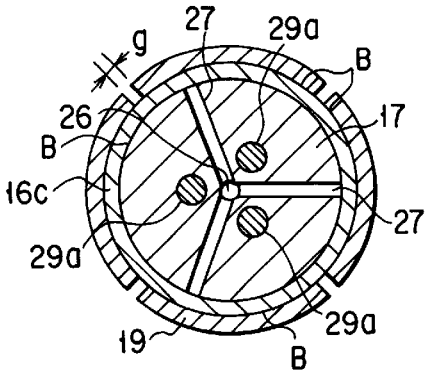
FIG. 4A
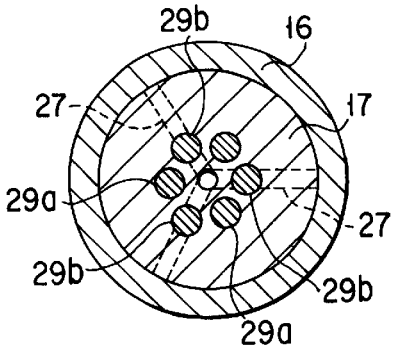
FIG. 4B
CHARACTERISTICS OF MAIN MATERIALS
| MATELIALS | HEAT CONDUCTIVITY AT 20°C (W/m·K) | THERMAL EXPANSION COEFFICIENT ($10^{-6}$/°C) | |
|---|---|---|---|
| | | 20°C~200°C | 20°C~800°C |
| MOLYBDENUM | 147 | 5 | 6 |
| TUNGSTEN | 170 | 4.5 | 5.5 |
| SKD 11 | 24 | 12 | 13 |
| SILVER | 400 | 20 | 26 |
| Cu (100%) | 390 | 18 | 22 |
| W(50%)/Cu(50%) | 300 | 14 | 18.5 |
| W(60%)/Cu(40%) | 260 | 12 | 15.5 |
| W(70%)/Cu(30%) | 220 | 10 | 12.5 |
| W(80%)/Cu(20%) | 180 | 8 | 9.5 |
FIG. 5
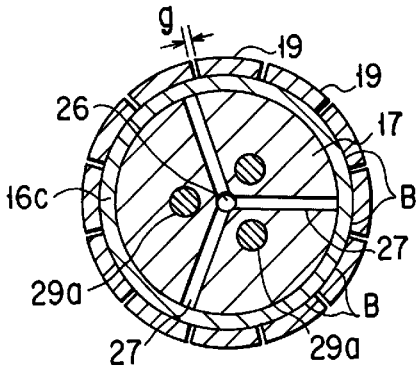
FIG. 6

X-RAY TUBE OF ROTARY ANODE TYPE

CROSS-REFERENCE TO RELATED APPLICATIONS

This application is based upon and claims the benefit of priority from the prior Japanese Patent Applications No. 11-295357, filed Oct. 18, 1999; No. 11-295358, filed Oct. 18, 1999; and No. 2000-130911, filed Apr. 28, 2000, the entire contents of which are incorporated herein by reference.

BACKGROUND OF THE INVENTION

The present invention relates to an X-ray tube of a rotary anode type, particularly, to an X-ray tube of a rotary anode type equipped with a slide bearing of a dynamic pressure type lubricated by a liquid metal.

FIG. 1 is a cross sectional view showing a gist portion of a conventional X-ray tube of a rotary anode type equipped with a slide bearing of a dynamic pressure type and an X-ray tube apparatus having the X-ray tube housed in a housing. Reference numeral 141 shown in FIG. 1 represents a vacuum vessel of an X-ray tube of a rotary anode type. A cathode 140 for emitting an electron beam, a disc-like rotary anode target 142, etc. are arranged within the vacuum vessel 141. Also, an X-ray emissive layer 143 for emitting an X-ray is arranged in that region of the disc-like rotary anode target 142 which faces the cathode 140.

The disc-like rotary anode target 142 is fixed to a support shaft 145 by a fixing nut 144. The support shaft 145 is joined to a rotor 146 formed cylindrical as a whole. The rotor 146 is of a three-layer structure consisting of an outer cylinder 146*a*, an intermediate cylinder 146*b* and an inner cylinder 146*c* having a bottom. The support shaft 145 is joined to the intermediate cylinder 146*b*.

A columnar stationary structure 147 is inserted into the inside of the inner cylinder 146*c*. A spiral groove 148 having a herringbone pattern is formed on the surface of the stationary structure 147, and a metal lubricant such as a Ga—In—Sn alloy, which is in the form of a liquid at least during the operation of the X-ray tube, is supplied into a gap including the slide bearing section of a dynamic pressure type formed between the stationary structure 147 and the rotor 146 and into the spiral groove 148.

A lubricant storage chamber (not shown) for receiving the liquid metal lubricant is arranged in a central portion of the stationary structure 147. A plurality of lateral lubricant passageways or ducts are arranged in radial directions between the lubricant storage chamber and the slide bearing of the dynamic pressure type. The liquid metal lubricant housed in the lubricant storage chamber is supplied through the lubricant passageways into the slide bearing section of the dynamic pressure type.

The inner cylinder 146*c* of the rotor and the stationary structure 147, which collectively constitute the slide bearing of the dynamic pressure type, are arranged such that about 20 $\mu$m of the bearing clearance can be maintained during the operation of the X-ray tube. Each of the inner cylinder 146*c* and the stationary structure 147, which collectively form the bearing surface, is made of a metal material such as an iron alloy tool steel, e.g., SKD-11 (JIS standards). The heat conductivity of SKD-11 is relatively small, i.e., 24 W/m·K at room temperature.

Two stepped portions 149, 150 are annularly arranged a certain distance apart from each other in the vertical direction in the outer circumferential portion of the stationary structure 147. The outer diameter of the stationary structure 147 is changed in each of the stepped portions 149 and 150 such that the diameter of the stationary structure 147 in the lower end portion positioned on the opposite side of the disc-like rotary anode target 142 is made smaller. A projecting portion 151 is annularly formed in the outer circumferential portion of the stepped portion 150 positioned in the lower portion. Also, a metal ring 152 is arranged on the outside of the projecting portion 151 in a manner to surround the stationary structure 147. Annular projecting portions 153 and 154 are arranged on the inner circumferential portion and the outer circumferential portion, respectively, of the metal ring 152. An outer edge portion 147*a* of the stationary structure 147 positioned in the lower portion in FIG. 1 extends to the outside of the vacuum vessel 141 so as to be utilized as a portion at which the X-ray tube of the rotary anode type is fixed to a housing 155.

The vacuum vessel 141 comprises a large diameter portion 141*a* made of a metal and surrounding the main portion of the disc-like rotary anode target 142 and a small diameter portion 141*b* surrounding the main portions of the rotor 146 and the stationary structure 147. The small diameter portion 141*b* is made of, for example, glass, and a seal ring 156 made of a thin metal body is bonded to the edge portion of the small diameter portion 141*b*. The tip portion of the seal ring 156 is hermetically welded to the tip portion of the projecting portion 154 on the outer circumferential portion of the sealing metal ring 152. Also, the tip portion of the projecting portion 153 in the inner circumferential portion of the sealing metal ring 152 is hermetically welded to the tip portion of the projecting portion 151 formed in the stepped portion 150 of the stationary structure 147. In this fashion, the stationary structure 147 is hermetically sealed to the vacuum vessel 141. A stator 157 serving to impart a rotating force to the rotary structure 146 is arranged on the outside of the small diameter portion 141*b* of the vacuum vessel 141. The stator 157 comprises an iron core and a coil wound about the iron core.

In the X-ray tube of the rotary anode type constructed as described above, the edge portion 147*a* of the stationary structure 147 is fixed to the bottom in the central portion of a pot-like holding member 158 made of an insulating material. In the holding member 158, the open edge portion of the cylindrical portion 158*b* is fixed to the housing 155 by a plurality of bolts 160. Also, a through-hole is formed in the central portion of the bottom of the holding member 158, and a top-shaped metal ring 158*a* having a central through-hole 159 is fixed to the bottom portion of the holding member 158 by a plurality of bolts 161. The outer edge portion 147*a* of the stationary structure 147 extends through the central through-hole 159 of the metal ring 158*a*.

The outer diameter of the metal ring 158*a* is inwardly tapered toward the inside of the vacuum vessel 141 and an annular projecting portion 162 is formed in the inner circumferential portion in contact with the outer edge portion 147*a* of the stationary structure 147. Where the outer edge portion 147*a* of the stationary structure 147 is fixed to the metal ring 158*a*, the tip surface of the projecting portion 162 of the metal ring 158*a* is brought into contact with the stepped portion 150 of the stationary structure 147.

The outer edge portion 147*a* of the stationary structure 147 is fastened and fixed to the metal ring 158*a* by a nut 163 engaged with a male screw formed on the outer circumferential wall of the outer edge portion 147*a* of the stationary structure 147. In fastening the nut 163, the stationary structure outer edge portion 147*a*, which is to be fixed, is pulled downward in FIG. 1 so as to strengthen the contact between the tip surface of the projecting portion 162 and the stepped portion 160 of the stationary structure 147, with the result that the X-ray tube of the rotary anode type is fixed to the holding member 158.

A shielding member 164 shielding the X-ray and made of lead is arranged inside the housing 155 housing the X-ray tube of the rotary anode type. An insulating cooling oil is loaded in and circulated through the shielding member 164. Also, an X-ray radiation window 165 for taking out the X-ray to the outside is arranged in a region positioned sideward of the X-ray emissive layer 143. A circulating hole for circulating the insulating cooling oil is formed in the pot-like portion 158*b* and in the metal ring 158*a* of the holding member 158, and an inlet port 166 for introducing the insulating cooling oil is formed in the portion of the housing 155 positioned sideward of the holding member 159. The insulating cooling oil supplied through the inlet port 166 is allowed to flow through the clearance between the vacuum vessel 141 of the X-ray tube of the rotary anode type and the housing 155, as denoted by arrows Y.

In the conventional X-ray tube of the rotary anode type, the heat generated from the rotary anode target is transmitted from the anode to the vacuum vessel by radiation and, then, transmitted from the vacuum vessel into the insulating cooling oil so as to be dissipated. A part of the heat generated from the rotary anode target and the heat generated by the rotation of the slide bearing of the dynamic pressure type are conducted to, for example, the rotor constituting the anode rotary mechanism so as to be dissipated partly from the outer circumferential surface of the rotor. The remaining heat is further conducted via the bearing to the stationary structure and, then, to the stationary structure outer edge portion positioned outside the vacuum vessel so as to be dissipated to the outside of the tube.

It should be noted that the liquid metal lubricant consisting of, for example, a Ga alloy, which is supplied to the slide bearing section of the dynamic pressure type, is highly active. If the bearing section is heated to a high temperature, the liquid metal lubricant reacts with the metal material forming the stationary structure and the bearing surface of the rotor. As a result, a reacted metal layer is accumulated on the bearing surface so as to gradually decrease the depth of the spiral groove and the clearance or gap between the bearing surfaces, leading to deterioration of the rotary characteristics in some cases. It should also be noted that, if the bearing section is heated to a high temperature, a gas tends to be generated from various materials. What should be noted is that it is conceivable for the liquid metal lubricant to be pushed out of the bearing section by the gas bubbles thus generated so as to leak to the outside.

A measure for suppressing the temperature elevation in the rotor and the bearing section of the stationary structure is proposed in, for example, Japanese Patent Disclosure (Kokai) No. 7-130311. Specifically, it is proposed that the core portion of the stationary structure is made of a material having a high conductivity, and the heat transmitted to reach the stationary structure is further transmitted through the core portion of the stationary structure so as to be dissipated to the outside of the vacuum vessel. In this prior art, a molten metal, mainly a molten copper, is poured into the core portion of the stationary structure so as to form a body having a high heat conductivity. Naturally, it is difficult to manufacture the stationary structure. Also, the stationary structure is low in its mechanical strength.

It is also known to the art that heat dissipating fins are mounted to the outer edge portion of the stationary structure extending to the outside of the vacuum vessel of the X-ray tube of the rotary anode type, and an insulating oil is brought into direct contact with the heat dissipating fins for cooling the fins. Further, it is known to the art that a cooling medium is introduced into and circulated through a void formed inside the stationary structure so as to enhance the cooling efficiency.

However, in the cooling structure for cooling the outer edge portion of the stationary structure, it is difficult to obtain a sufficient heat dissipation effect because the outer edge portion of the stationary structure is considerably apart from the bearing section. On the other hand, in the structure in which a cooling medium is circulated through the inside of the stationary structure, the mechanical strength of the stationary structure is lowered because of formation of the hole reaching the inner region of the stationary structure.

Incidentally, the temperature of the slide bearing section of the dynamic pressure type is rendered nonuniform partly because a part of the heat generated from the rotary anode target is transmitted to the slide bearing section and partly because heat is generated from the bearing section itself. As a result, an undesired reaction tends to proceed between the liquid metal lubricant and the bearing surface in the high temperature portion.

BRIEF SUMMARY OF THE INVENTION

An object of the present invention is to provide an X-ray tube of a rotary anode type, which permits preventing the temperature in the slide bearing section of the dynamic pressure type from becoming nonuniform and also permits suppressing the temperature elevation in the slide bearing section, which permits facilitating the manufacture and also permits increasing the mechanical strength of, particularly, the stationary structure, and which further permits maintaining stable rotary characteristics over a long period of time.

According to a first aspect of the present invention for achieving the object described above, there is provided an X-ray tube of a rotary anode type, in which at least one hole is so formed as to extend from an edge portion of a stationary structure along an axis of the stationary structure within a position avoiding a lubricant storage chamber and a lubricant passageway, and a heat transfer member having a heat conductivity higher than that of the stationary structure is inserted into the hole to form an integral structure.

According to a second aspect of the present invention for achieving the object described above, there is provided an X-ray tube of a rotary anode type, in which a rotor is formed of a plurality of cylindrical structures, and a heat transfer member having a heat conductivity higher than that of an inner cylindrical structure included in the plural cylindrical structures is bonded in a substantially cylindrical form to the outer circumferential wall of the inner cylindrical structure forming a slide bearing of the dynamic pressure type together with the stationary structure.

According to a third aspect of the present invention for achieving the object described above, there is provided an X-ray tube of a rotary anode type, in which at least one hole is formed to extend from an edge portion of a stationary structure within a position avoiding a lubricant storage chamber and a lubricant passageway, a heat transfer member having a heat conductivity higher than that of the stationary structure is inserted into the hole to form an integral structure, a rotor is formed of a plurality of cylindrical structures, and a heat transfer member having a heat conductivity higher than that of an inner cylindrical structure included in the plural cylindrical structures is bonded in a substantially cylindrical form to the outer circumferential wall of the inner cylindrical structure forming a slide bearing of the dynamic pressure type together with the stationary structure.

According to a fourth aspect of the present invention for achieving the object described above, there is provided an X-ray tube of a rotary anode type, in which a hole is formed to extend from an edge portion of a stationary structure within a position avoiding a lubricant storage chamber and a lubricant passageway, a heat transfer member having a heat conductivity higher than that of the stationary structure is inserted into the hole to form an integral structure, and a fluid passageway for circulating a cooling medium is formed in the heat transfer member.

Further, according to a fifth aspect of the present invention for achieving the object described above, there is provided an X-ray tube of a rotary anode type, in which a first portion of a stationary structure in which a slide bearing of a dynamic pressure type is arranged is formed of a predetermined first material, a second portion positioned farther from the rotary anode target than the first portion of the stationary structure is formed of a second material having a heat conductivity higher than that of the first material, and the first portion and the second potion are integrally joined to each other in a position avoiding the lubricant storage chamber and the lubricant passageway.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 4A is a lateral cross sectional view along the line 3*a*—3*a* shown in each of FIGS. 2 and 3;

FIG. 4B is a lateral cross sectional view along the line 3*b*—3*b* shown in each of FIGS. 2 and 3;

FIG. 5 is a table showing the properties of the materials used in the bearing section of the X-ray tube according to the first embodiment of the present invention;

FIG. 6 is a lateral cross sectional view schematically showing an X-ray tube according to another embodiment of the present invention;

DETAILED DESCRIPTION OF THE INVENTION

Figure 1:
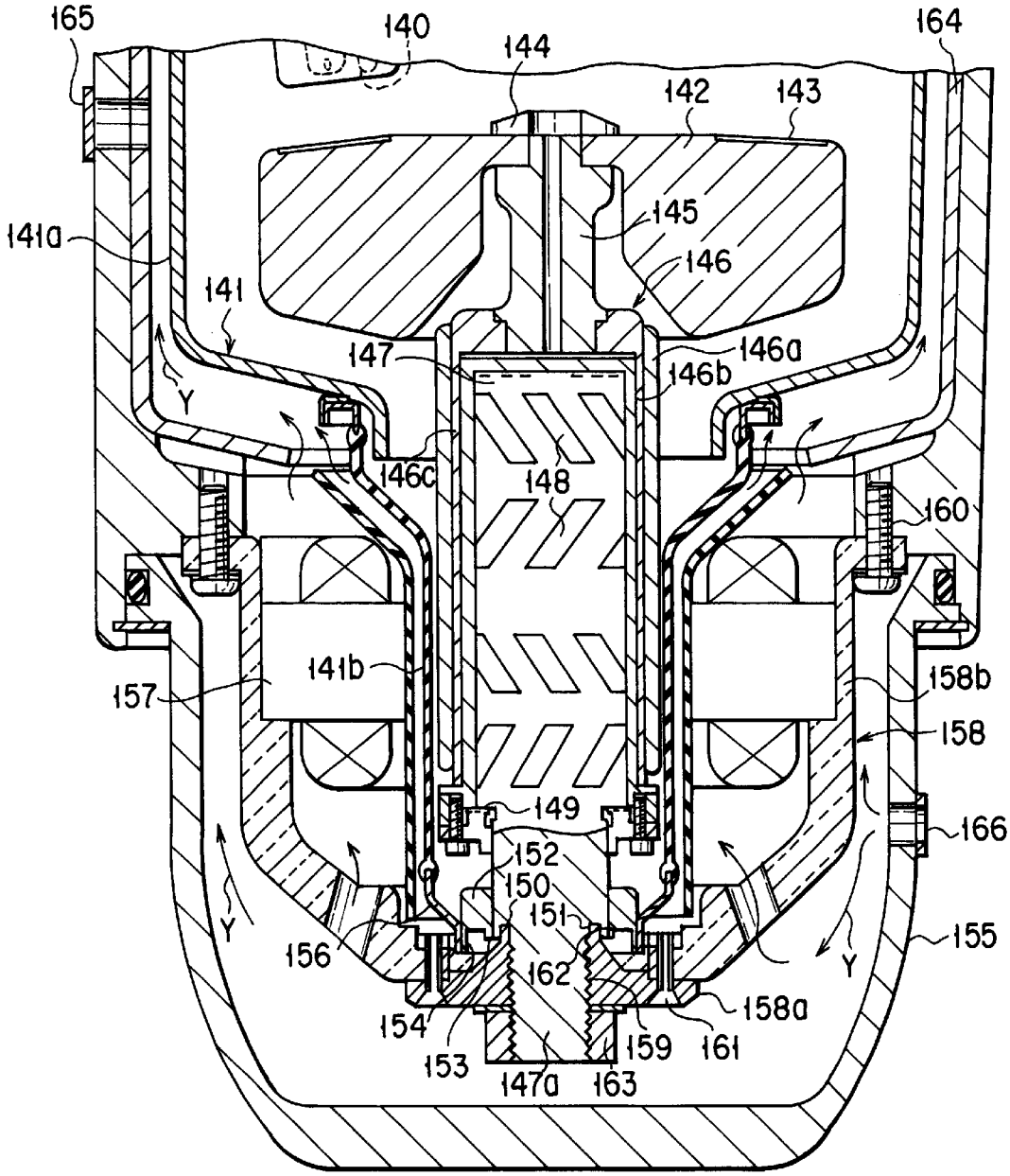
FIG. 1 is a vertical cross sectional view schematically showing a part of an X-ray tube apparatus equipped with a general X-ray tube of a rotary anode type.

X-ray tubes of a rotary anode type according to some embodiments of the present invention will now be described with reference to the accompanying drawings. Incidentally, the same constituents of the X-ray tube are denoted by the same reference numerals throughout the accompanying drawings so as to avoid an overlapping description.

Figure 2:
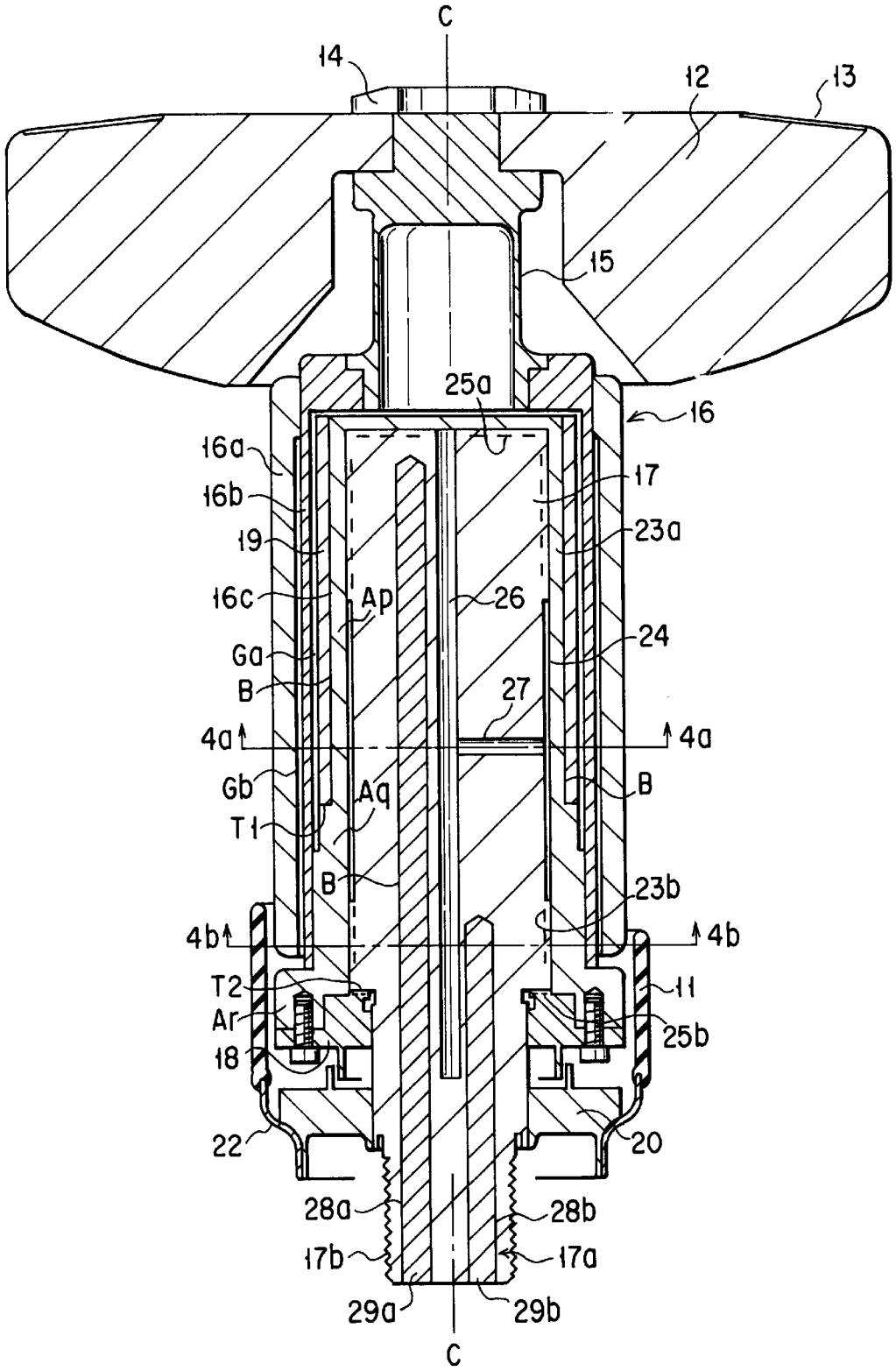
FIG. 2 is a vertical cross sectional view schematically showing an X-ray tube of a rotary anode type according to one embodiment of the present invention.
Figure 3:
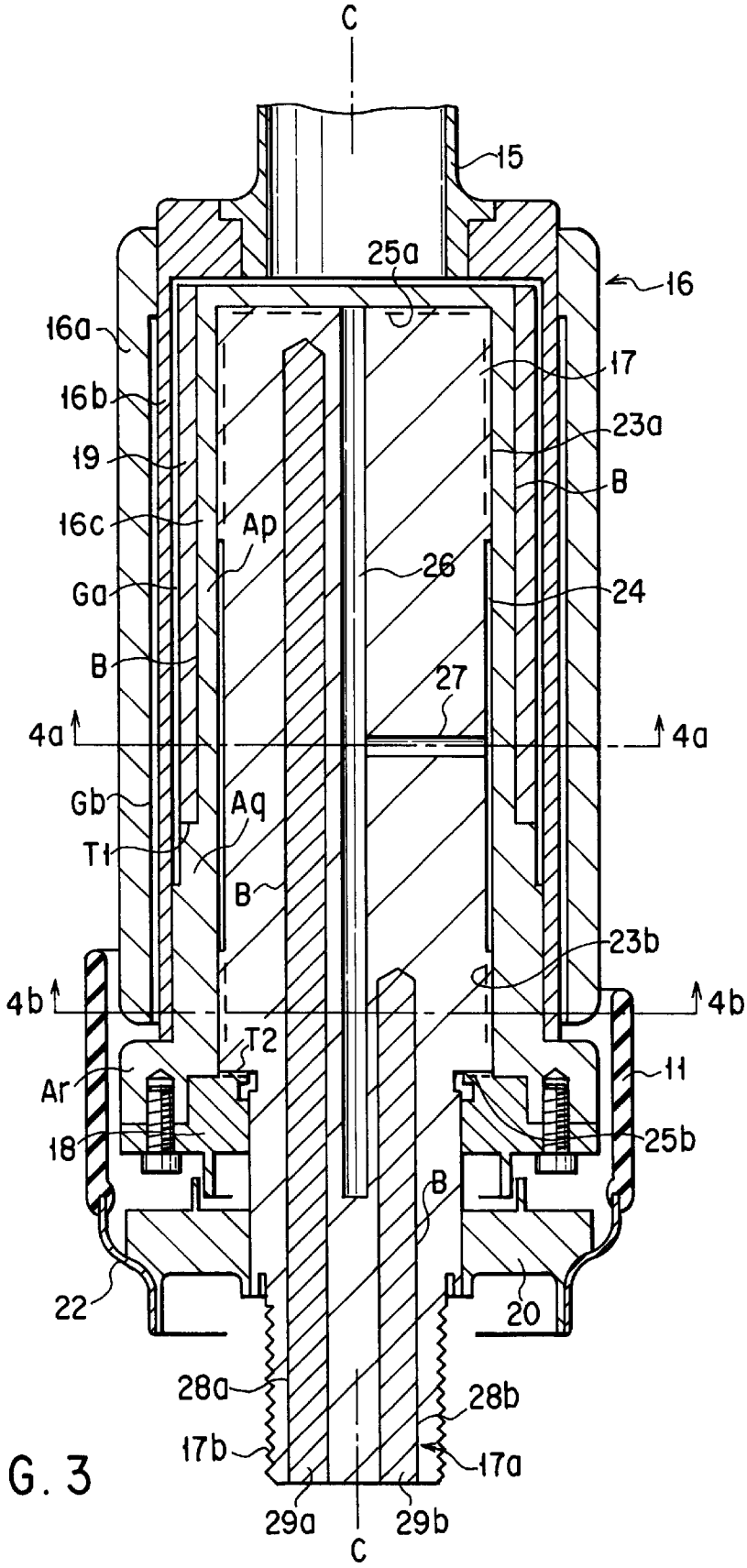
FIG. 3 is a vertical cross sectional view schematically showing in a magnified fashion a part of the X-ray tube of a rotary anode type shown in FIG. 2.

FIGS. 2 to 4B collectively show an X-ray tube of a rotary anode type according to a first embodiment of the present invention; wherein FIG. 2 shows an X-ray tube of a rotary anode type according to the first embodiment of the present invention, FIG. 3 shows in a magnified fashion the portions of the rotary anode target and the stationary structure shown in FIG. 2, FIG. 4A is a lateral cross sectional view along the line 3*a*—3*a* in each of FIGS. 2 and 3 showing the inside cylinder of the rotor and the stationary structure, and FIG. 4B is a lateral cross sectional view along the line 3*b*—3*b* in each of FIGS. 2 and 3 showing the inside cylinder of the rotor and the stationary structure.

Reference numeral 11 shown in these drawings denotes a vacuum vessel constituting an X-ray tube of a rotary anode type. In FIG. 2, the vacuum vessel 11 is shown only partly. A cathode (not shown) for emitting an electron beam, a disc-like rotary anode target 12, etc. are arranged within the vacuum vessel 11. The most portion of the disc-like rotary anode target 12 is formed of molybdenum or a molybdenum alloy, and an X-ray emissive layer 13 for emitting an X-ray to a focusing region facing the cathode and made of tungsten or a rhenium-tungsten alloy is mounted to the disc-like rotary anode target 12.

The disc-like rotary anode target 12 is fixed to a support shaft 15 by a fixing nut 14, and the support shaft 15 is jointed to a rotor 16 of a rotating mechanism. The rotor 16 is of a three-layer structure consisting of an outer cylinder 16*a*, an intermediate cylinder 16*b* and an inner cylinder 16*c* having a bottom. The intermediate cylinder 16*b* is joined to the support shaft 15. Also, a thrust ring 18 is fixed by a screw engagement to the lower open end portion of the inner cylinder 16*c*.

The outer cylinder 16*a* of the rotor is made of a copper body having a black film attached to the outer circumferential surface so as to improve the heat radiation properties. The intermediate cylinder 16*b* is made of, for example, an alloy consisting of 50% by weight of iron and 50% by weight of nickel (hereinafter referred to as "TNF material"), which exhibits a high mechanical strength even under high temperatures. Further, the inner cylinder 16*c* having a bottom is made of a material having a relatively high hardness and unlikely to be corroded by a liquid lubricant because the inner circumferential surface of the inner cylinder 16*c* forms a bearing surface. For example, the inner cylinder 16*c* is made of an iron alloy tool steel of SKD-11 (JIS specification).

Incidentally, the TNF material noted above has a very small heat conductivity of about 16 W/m·K. Since the intermediate cylinder 16*b* is made of the TNF material, the heat transfer of the intermediate cylinder itself is suppressed. Also, the heat transfer from the rotary anode target to the bearing section can be markedly suppressed since a heat insulating space Ga is formed inside the intermediate cylinder 16*b* as described hereinlater. Further, the TNF material has a thermal expansion coefficient of about $10\times10^{-6}$/° C., which is close to the value for SKD-11 forming the inner cylinder 16*c*.

The inner cylinder 16*c* and the intermediate cylinder 16*b* are joined to each other by, for example, brazing in a somewhat lower portion in FIG. 2, which is far from the disc-like rotary anode target 12 in terms of the heat transfer route. Also, a first clearance Ga for heat insulation is formed between the outer circumferential surface of the inner cylinder 16*c* and the intermediate cylinder 16*b* in the portion upward of the brazed portion noted above.

Likewise, the intermediate cylinder 16*b* and the outer cylinder 16*a* are joined to each other by brazing in the engaged portion close to the disc-like rotary anode target 12, and a second clearance Gb for heat insulation is formed in the remaining portion, i.e., in the clearance between the intermediate cylinder 16*b* and the outer cylinder 16*a* extending downward from the brazed portion.

A first stepped portion T1 is formed in a part of the outer circumferential wall of the inner cylinder 16*c*, i.e., in a region close to the lower end of the portion where the heat insulating clearance Ga is formed. A first portion Ap of the inner cylinder 16*c*, which is positioned upward of the first stepped portion T1, is formed to have an outer diameter smaller than the outer diameter of a second portion Aq of the inner cylinder 16*c* positioned downward of the first stepped portion T1.

As shown in FIG. 4A, a heat transfer member 19 for the rotor is bonded by, for example, brazing to the outer circumferential wall of the first portion Ap of the rotor having a small outer diameter in a manner to form substantially a cylindrical configuration. The bonding portion of the heat transfer member 19 is denoted by a letter B in the drawing. The thickness of the heat transfer member 19 for the rotor is set to permit the outer circumferential surface of the heat transfer member 19 to be flush with the outer circumferential surface of the second portion Aq. In the embodiment shown in the drawing, the heat transfer member 19 for the rotor consists of four arcuate plate members of the same size prepared by dividing a cylindrical member into four sections in the radial direction. The divided four sections (arcuate members) are arranged with a predetermined small clearance g formed between the adjacent divided sections so as to form the heat transfer member 19, which is substantially cylindrical. Also, the heat transfer member 19 for the rotor is made of a material having a heat conductivity larger than that of the inner cylinder 16*c*. For example, the heat transfer member 19 is made of a composite material prepared by impregnating a tungsten sintered material with 35% by weight of copper.

A second stepped portion T2 is formed in a part of the inner circumferential surface of the inner cylinder 16*c*, e.g., in a portion below the first stepped portion T1. The second portion Aq of the inner cylinder 16*c* positioned above the second stepped portion T2 is formed to have an inner diameter smaller than that of a third portion Ar of the inner cylinder 16*c* positioned below the second stepped portion T2.

A substantially columnar stationary structure 17 is inserted into the space within the inner cylinder 16*c*. A lower edge portion 17*a* of the stationary structure 17 extends through the central open portion of a thrust ring 18 so as to be fixed to a part of a sealing metal ring 20 and further extends to the outside of the vacuum vessel 11. The lower edge of the stationary structure 17, i.e., the outer edge portion 17*a* positioned on the opposite side of the disc-like rotary anode target 12, is utilized as a portion at which the X-ray tube of the rotary anode type is fixed to a housing (not shown). The stationary structure 17 is hermetically welded to the inside of the sealing metal ring 20, and the outside of the sealing metal ring 20 is hermetically welded to a seal ring 22 formed of a thin metal body, which is fixed to the vacuum vessel 11. As a result, the stationary structure 17 is sealed air-tight to the vacuum vessel 11.

Two sets of spiral grooves 23*a*, 23*b* each having a pattern like herringbone pattern are formed in parts of the outer circumferential surface of the stationary structure 17 so as to form a radial slide bearing of a dynamic pressure type between the rotor 16 and the stationary structure 17. A recess 24 for storing partly a liquid metal lubricant is formed in that region of the outer circumferential surface of the stationary structure 17 which is sandwiched between the upper and lower spiral grooves 23*a* and 23*b*. It should be noted that a clearance including about 20 μm of the bearing clearance is maintained between the inner cylinder 16*c* of the rotor 16 and the stationary structure 17 during operation of the X-ray tube.

Also, a spiral groove 25*a* having a circular herringbone pattern is formed on the bottom surface of the inner cylinder 16*c* on the side of the disc-like rotary anode target and on the upper surface of the stationary structure 17 facing the bottom surface of the inner cylinder 16*c* noted above so as to form a slide bearing of a dynamic pressure type in the thrust direction. Likewise, a spiral groove 25*b* is formed on the lower surface of the second stepped portion T2 of the stationary structure 17 and on the upper surface of the thrust ring 18 positioned close to and facing the lower surface of the stepped portion T2 noted above so as to form a slide bearing of a dynamic pressure type in the thrust direction.

Each of the inner cylinder 16*c* of the rotor, the stationary structure 17 and the thrust ring 18, which are engaged with each other and positioned close to each other, is made of, for example, SKD-11 referred to previously.

A lubricant storage chamber 26 for housing a liquid metal lubricant is formed by a hole formed in the central portion of the stationary structure 17 and extending along the axis C of rotation of the X-ray tube. The upper end of the lubricant storage chamber 26 is open in the upper surface of the stationary structure 17. Three lateral lubricant passageways 27 are radially arranged about 12° apart from each other between the lubricant storage chamber 26 and the recess 24 formed on the outer circumferential surface of the stationary structure 17. In other words, the lubricant passageway 27 is branched into three branches in a direction differing from the extending direction of the lubricant storage chamber 26.

Incidentally, the lubricant passageways are formed to communicate with the recess 24 in the embodiment shown in the drawings. However, it is possible to form an appropriate number of lubricant passageways to communicate with the regions where the lubricant pressure within the spiral grooves is relatively lowered during operation of the X-ray tube. It should be noted that a metal lubricant, e.g., a Ga—In—Sn alloy, which is in the form of a liquid at least during operation of the X-ray tube, is supplied to the clearance including the bearing clearance formed among the rotor 16, the stationary structure 17 and the thrust ring 18, as well as the spiral grooves 23*a*, 23*b*, 25*a*, 25*b*, the lubricant storage chamber 26, the lubricant passageways 27, and the recess 24. In this fashion, the liquid metal lubricant housed in the lubricant storage chamber 26 is supplied to the bearing section of the dynamic pressure type through the open portion of the lubricant storage chamber 26, the lubricant passageways 27, the recess 24, etc. during operation of the X-ray tube.

A first set of three holes 28*a* are formed to extend upward along the tube axis from the tip surface of the outer edge 17*a* positioned on the opposite side of the disc-like rotary anode target 12. Likewise, a second set of three holes 28*b* shorter than the hole 28*a* are formed to extend upward along the tube axis from the tip surface of the outer edge 17*a* noted above. As shown in FIG. 4A, a first set of three heat transfer members 29*a* are tightly engaged with the three long holes 28*a*. These heat transfer members 29*a* are integrally bonded by brazing to the inner surfaces of the holes 28*a*. Likewise, a second set of three heat transfer members 29*b* are tightly engaged with the three short holes 28*b*, as shown in FIG. 4B. These heat transfer members 29*b* are integrally bonded by brazing to the inner surfaces of the holes 28*b*. The bonded portions of these heat transfer members 29 are similarly denoted by a letter B.

These long holes 28*a* and the heat transfer members 29*a* inserted into these long holes 28*a* are arranged in positions displaced from the axis C of the X-ray tube so as to avoid the lubricant storage chamber 26 formed in the stationary structure, and are arranged about 120° apart from each other in the circumferential direction. Likewise, these short holes 28*b* and the heat transfer members 29*b* inserted into these short holes 28*b* are arranged in positions displaced from the axis C of the X-ray tube so as to avoid the lubricant storage chamber 26 formed in the stationary structure, and are arranged about 120° apart from each other in the circumferential direction. In addition, these long holes 28*a* and the heat transfer members 29*a* are arranged to avoid the positions of the lubricant passageways 27 and extend beyond the lubricant passageways 27 to reach regions close to the end portion of the stationary structure on the side of the disc-like rotary anode target 12. On the other hand, the short holes 28*b* and the heat transfer members 29*b* inserted into the short holes 28*b* are arranged in the positions corresponding to the positions of the lubricant passageways 27 in the circumferential direction as viewed from above. However, these short holes 28*b* do not extend upward to reach the lubricant passageways 27.

Each of the heat transfer members 29*a* and 29*b* inserted into the long holes 28*a* and the short holes 29*a*, respectively, is made of a material, e.g., Cu, having a heat conductivity higher than that of the stationary structure 17. The stationary structure 17 differs from copper in the thermal expansion characteristics. In this case, however, the heat transfer member made of copper has a small diameter and is brazed to the inner surface of the hole. Therefore, no practical problem is brought about by the difference in the thermal stress between the two.

Incidentally, it is possible to use a composite material prepared by impregnating a tungsten sintered material with 35% by weight of copper for forming the heat transfer members 29*a*, 29*b* for the stationary structure as well as for forming the heat transfer member 19 for the rotor. Tungsten and copper are substantially incapable of forming a solid solution. Therefore, with increase in the weight ratio of copper to tungsten, the heat conducting characteristics and the thermal expansion characteristics of the composite material are rendered close to those of copper. It follows that it is possible to permit the thermal expansion characteristics of the heat transfer member 19 for the rotor and the heat transfer members 29*a*, 29*b* for the stationary structure to be close to the thermal expansion characteristics of the material forming the bearing section such as SKD-11 by controlling the weight ratio of copper of the composite material. The composite material suitable for use in the present invention includes, for example, "ELCONITE" (registered trademark of an electrical contact material manufactured by Kabushiki Kaisha Toshiba).

The X-ray tube of the rotary anode type described above is housed in a housing as shown in FIG. 1, and a male screw 17*b* of the outer edge portion 17*a* of the stationary structure is inserted through a metal fitting of the holding member and fastened by a nut so as to fix the X-ray tube. The resultant structure can be operated as an X-ray tube apparatus. Incidentally, it is possible to form longer the outer edge portion 17*a* of the stationary structure and to mount heat dissipating fins to the tip portion of the prolonged outer edge portion 17*a* so as to further improve the heat dissipation. Alternatively, it is possible to have the lower ends of the heat transfer members 29*a*, 29*b* for the stationary structure positioned lower than the end face of the outer edge portion 17*a* of the stationary structure. In this case, heat dissipating fins are mounted to the lower tip portions of the heat transfer members 29*a*, 29*b*, or an insulating cooling oil is directly blown against the lower tip portions of the heat transfer members 29*a*, 29, so as to further improving the heat dissipating properties.

FIG. 5 is a table showing the main materials forming the bearing and having good heat conducting characteristics. As apparent from the table of FIG. 5, the materials adapted for forming the heat transfer member include copper having a relatively high heat conductivity. Incidentally, copper differs in thermal expansion coefficient from the material forming the bearing such as SKD-11. Therefore, if copper is used for forming a heat transfer member for the rotor or a heat transfer member for the stationary structure, the thermal stress is increased by the high temperature during operation of the X-ray tube, e.g., about 220° C., or during vacuum degassing step of the bearing member, e.g., about 750° C., depending on the shape and size of the rotor or the stationary structure. It follows that it is possible for the members constituting the rotary mechanism to be deformed, leading to inaccuracy of size. On the other hand, a composite material consisting of 65% by weight of tungsten and 35% by weight of copper is close to SKD-11 in the thermal expansion coefficient. Therefore, in the case of using the particular composite material, the inaccuracy in size of the member is decreased and, at the same time, it is possible to obtain a high heat transfer efficiency.

According to the construction described above, the temperature of the bearing section elevated by the heat transferred to the bearing section via the heat transfer member for the rotor arranged to cover the outer circumferential surface of the inner cylinder of the rotor arranged relatively close to the bearing section and by the heat generated from the bearing section itself is made uniform promptly. Also, the heat in the bearing section can be efficiently transferred toward the outer edge of the stationary structure so as to be dissipated to the outside of the vacuum vessel, thereby suppressing the temperature elevation in the bearing section. Particularly, the heat transfer members for the rotor and the heat transfer members for the stationary structure are located to partially overlap with each other in the axial direction of the X-ray tube such that the bearing section is substantially sandwiched between heat transfer materials having a high heat transfer efficiency. It follows that the temperature of the bearing section is made uniform and the heat is dissipated from the bearing section to the outside with a high efficiency.

As a result, it is possible to suppress the change in size of the spiral grooves and the bearing clearance, making it possible to obtain an X-ray tube of a rotary anode type that permits maintaining stable rotating characteristics over a long period of time. It should also be noted that the stationary structure includes the outer edge portion positioned outside the vacuum vessel, and heat transfer members for the stationary structure are inserted into holes made in the stationary structure. However, it is possible to ensure a sufficiently high mechanical strength of the stationary structure by diminishing a ratio of the outer edge portion of the stationary structure to the heat transfer members for the stationary structure and by integrally fixing the heat transfer members to the stationary structure.

FIG. 6, which is directed to another embodiment of the present invention, is a lateral cross sectional view showing the inner cylinder of the rotor and the stationary structure in the positions corresponding to the positions shown in FIG. 4A. The same members of the structure are denoted by the same reference numerals so as to omit an overlapping description. In this embodiment, the heat transfer member 19 for the rotor consists of 12 arcuate plate members prepared by equally dividing a cylindrical member in the circumferential direction. These divided arcuate plate members are fixed by, for example, brazing to the outer circumferential wall of the inner cylinder 16*c* of the rotor so as to form a substantially cylindrical configuration.

As described above, the heat transfer member 19 for the rotor consists of 12 arcuate plate members. The reason for dividing the heat transfer member 19 into many small sections will now be described. It should be noted that the heat transfer member 19 for the rotor is made of a composite material prepared by impregnating a tungsten sintered material with 35% by weight of copper. As shown in FIG. 5, the thermal expansion coefficient of the composite material is close under low temperatures to that of SKD-11 constituting the bearing section. If the temperature is elevated, however, the thermal expansion coefficient of the composite material forming the heat transfer member is slightly larger than that of SKD-11. As a result, a thermal stress is generated in the case where the heat transfer member 19 for the rotor is brazed to the inner cylinder 16*c* or where the assembled bearing is subjected to a degassing treatment under high temperatures, with the result that the cylindrical structure portion of the inner cylinder 16*c* receives a compressive force so as to be deformed.

Such a deformation is caused in general by concentration of the stress in the valley portion of the clearance Ga between adjacent divided members, i.e., arcuate plate members, of the heat transfer member 19 for the rotor. The deformation tends to be brought about easily with decrease in the thickness of the inner cylinder 16*c*. However, if the heat transfer member 19 for the rotor is divided into many small arcuate sections, the thermal stress is distributed in the valleys of many clearances g between adjacent divided members of the heat transfer member 19 for the rotor. As a result, it is possible to moderate the excessive local concentration of the thermal stress so as to suppress the deformation in the cylindrical structure portion of the inner cylinder 16*c*.

In the embodiment described above, the heat transfer member 19 for the rotor is divided into many small sections in the circumferential direction. However, it is also possible for the heat transfer member 19 for the rotor to consist of a large number of rods rectangular in cross section and arranged along the outer circumferential surface of the inner cylinder or to consist of a cylindrical body having large number of slit-like grooves formed on the surface and arranged equidistantly apart from each other in the axial direction. Alternatively, where the diameter of the inner cylinder of the rotor is relatively small, it is possible for the heat transfer member 19 for the rotor to consist of a single cylindrical body.

Figure 7:
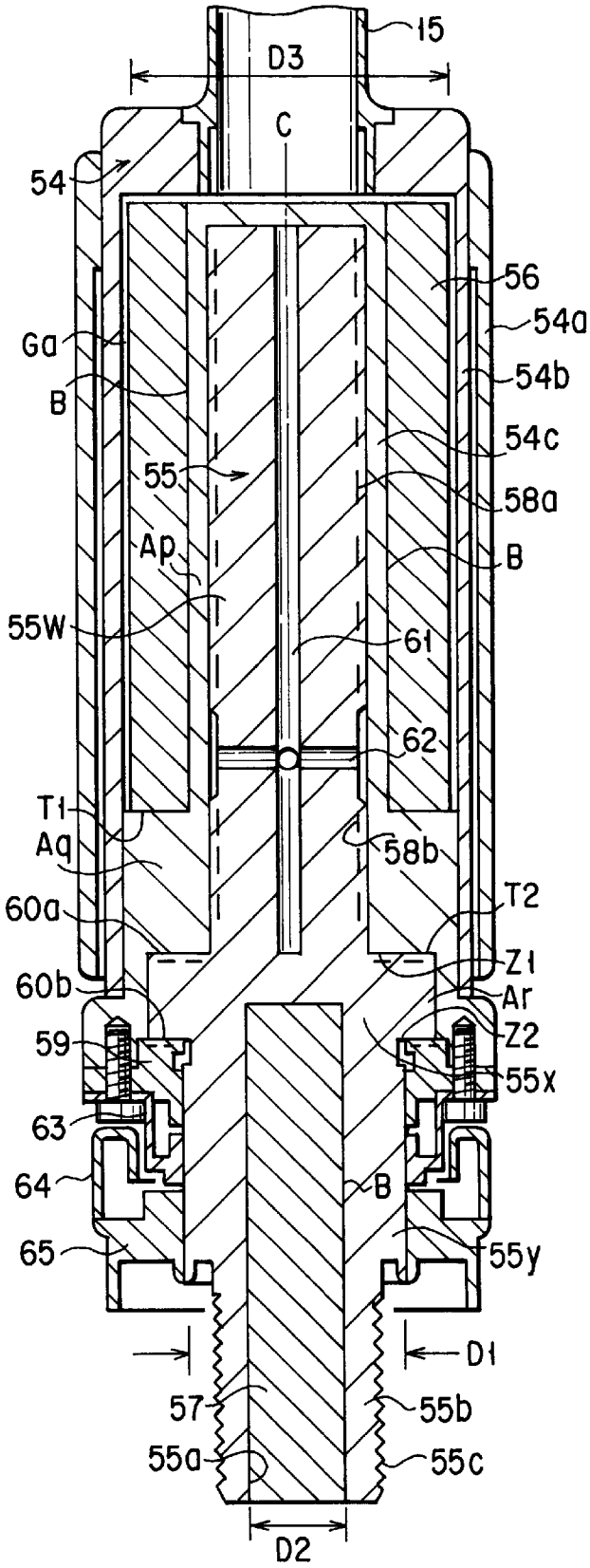
FIG. 7 is a vertical cross sectional view schematically showing in a magnified fashion a part of an X-ray tube of a rotary anode type according to another embodiment of the present invention.

FIG. 7 shows an X-ray tube according to another embodiment of the present invention. In this embodiment, the support shaft 15 to which the disc-like rotary anode target (not shown) is fixed is joined to a rotor 54. As in the embodiment described previously, the rotor 54 is of a three layer cylindrical structure consisting of an outer cylinder 54*a*, an intermediate cylinder 54*b* and an inner cylinder 54*c* having a bottom. A thrust ring 59 is fixed by screw engagement to the lower end opening of the inner cylinder 54*c*.

As in the embodiment described previously, the outer cylinder 54*a* of the rotor is made of a copper body having a black film attached to the outer circumferential surface. The intermediate cylinder 54*b* is made of a TNF material. Further, each of the inner cylinder 54*c* having a bottom and the thrust ring 59 is made of SKD-11.

A stepped portion T1 is formed in a part of the outer circumferential surface of the inner cylinder 54*c*. An upper portion Ap of the inner cylinder 54*c* positioned above the stepped portion T1 is formed smaller in outer diameter than a lower portion Aq positioned below the stepped portion T1. Also, a thick cylindrical or divided heat transfer member 56 for the rotor is integrally bonded by, for example, brazing to the outer circumferential surface of the upper portion Ap having a smaller outer diameter.

The thickness in the radial direction of the heat transfer member 56 for the rotor is set to permit the outer circumferential surface of the heat transfer member 56 to be aligned with the outer circumferential surface in the lower portion Aq of the inner cylinder 54*c*. The heat transfer member 56 for the rotor is made of a material having heat conductivity higher than that of the inner cylinder 54*c*. For example, the heat transfer member 56 is made of a composite material prepared by impregnating a tungsten sintered material with copper, e.g., 60% by weight of tungsten and 40% by weight of copper.

A stepped portion T2 is formed in a part of the inner circumferential surface of the inner cylinder 54*c* positioned lower than the stepped portion T1. The inner diameter of the upper portion Aq of the inner cylinder 54*c* positioned above the stepped portion T2 is made smaller than that of the lower portion Ar positioned below the stepped portion T2. As shown in the drawing, a stationary structure 55 is inserted into the inner space of the inner cylinder 54*c* with a small bearing clearance held between the outer circumferential surface of the inner cylinder 54*c* and the inner circumferential surface of the stationary structure 55.

The stationary structure 55 is formed to conform with the inner space of the inner cylinder 54*c* and consists of a first small diameter portion 55*w* having a small outer diameter, a large diameter portion 55*x* having an outer diameter larger than that of the first small diameter portion 55*w*, and a second small diameter portion 55*y* having an outer diameter smaller than that of the large diameter portion 55*x*. A stepped portion Z1 is formed at the boundary between the first small diameter portion 55*w* and the large diameter portion 55*x*. Also, a stepped portion Z2 is formed at the boundary between the large diameter portion 55*x* and the second small diameter portion 55*y*.

A hole 55*a* having a relatively large inner diameter is formed to extend along the axis C of the X-ray tube from the edge plane of the outer edge portion 55*b* of the stationary structure 55 to reach the large diameter portion 55*x*. A heat transfer member 57 for the stationary structure is bonded by, for example, brazing to the inner circumferential surface of the hole 55*a* so as to permit the heat transfer member 57 to be tightly engaged with the hole 55*a*. The heat transfer member 57 for the stationary structure is made of a material having a heat conductivity higher than that of the stationary structure 55. For example, the heat transfer member 57 is made of a composite material prepared by impregnating a tungsten sintered material with copper, e.g., 65% by weight of tungsten and 35% by weight of copper.

Spiral grooves 58*a*, 58*b* each having a herringbone pattern are formed in upper and lower regions on the side surface of the first small diameter portion 55*w* of the stationary structure 55. Slide bearings of a dynamic pressure type are formed in the radial direction between these spiral grooves 58*a*, 58*b* and the rotor 54. On the other hand, a spiral groove 60*a* having a circular herringbone pattern is formed in the stepped portion Z1 facing the stepped portion T1 of the inner cylinder 54*c*. Also, a spiral groove 60*b* having a circular herringbone pattern is formed on the upper surface of the thrust ring 59 fixed by a screw engagement to the lower end portion of the rotor 54 and positioned in contact with the surface of the stepped portion Z2. As a result, slide bearings of a dynamic pressure type are formed in the thrust direction between these spiral grooves 60*a*, 60*b* and the rotor 54. In this embodiment, the diameter of each of the slide bearing sections of the dynamic pressure type is made smaller than that in the embodiment shown in FIGS. 2 and 3. As a result, the bearing resistance is diminished during the rotating operation of the X-ray tube and, thus, the X-ray tube is adapted for the operation at a high speed.

A lubricant storage chamber 61 for housing a liquid metal lubricant is formed in the central portion of the stationary structure 55 in a manner to extend along the axis C of the X-ray tube. The upper end of the lubricant storage chamber 61 is open on the upper end face of the stationary structure 55. Also, lateral lubricant passageways 62 branched from the lubricant storage chamber 61 are radially arranged in the stationary structure 55 between the lubricant storage chamber 61 and the slide bearing of a dynamic pressure type. The liquid metal lubricant housed in the lubricant storage chamber 61 is supplied to the bearing section of the dynamic pressure type through the upper opening of the lubricant storage chamber 61 and the lubricant passageway 62.

A first trap ring 63 joined to the rotary portion and a second trap ring 64 joined to the stationary portion are mounted below the thrust ring 59 so as to prevent the liquid metal lubricant from leaking into the vacuum space. The second trap ring 64 is fixed to a sealing metal ring 65. Incidentally, a male screw 55*c* for the fastening and fixation is formed on the outer circumferential surface of the outer edge portion 55*b* of the stationary structure.

In the embodiment of the construction described above, the heat transfer member 56 for the rotor is bonded to the inner cylinder 54*c* of the rotor 54. Also, the heat transfer member 57 for the stationary structure is inserted into the hole made in the edge plane of the stationary structure 55. It should be noted that each of these heat transfer member 56 for the rotor and heat transfer member 57 for the stationary structure is made of a material having a high heat conductivity, e.g., a composite material prepared by impregnating a tungsten sintered material with copper.

It follows that the heat transmitted to the rotor and the heat generated from the bearing section are promptly distributed among the bearing sections so as to make the temperature uniform. Also, the heat is dissipated through the stationary structure, etc. to the outside of the X-ray tube with a high efficiency so as to suppress the temperature elevation in the bearing section. It should also be noted that the heat transfer member for the stationary structure is inserted into the hole made in the outer edge portion of the stationary structure extending to the outside of the vacuum vessel. However, it is possible to maintain a sufficiently high mechanical strength of the stationary structure by diminishing a ratio in the lateral cross sectional area of the heat transfer member for the stationary structure to the outer edge portion of the stationary structure or by integrally bonding by, for example, brazing the heat transfer member for the stationary structure to the outer edge portion of the stationary structure.

Incidentally, tungsten and copper forming the composite material substantially fail to form a solid solution. As a result, if the weight ratio of copper to tungsten is increased, the heat transfer characteristics and the thermal expansion characteristics of the composite material are rendered close to those of copper itself. It follows that it is possible to permit the thermal expansion characteristics of the heat transfer member for the rotor and the heat transfer member for the stationary structure to be close to those of the material of the bearing section such as SKD-11 by adjusting the copper content of the composite material.

For example, a composite material consisting of 65% by weight of tungsten and 35% by weight of copper has a thermal expansion coefficient close to that of SKD-11. It follows that, in the case of using the composite material exemplified above, it is possible to decrease the thermal stress occurring in the bonding portion between the inner cylinder 54*c* of the rotor and the heat transfer member 56 for the rotor and occurring in the bonding portion between the stationary structure 55 and the heat transfer member 57 for the stationary structure. As a result, deformation of the parts caused by the difference in thermal expansion coefficient can be prevented and, at the same time, it is possible to obtain a high heat transfer effect.

The high heat transfer effect in the outer edge portion 55*b* of the stationary structure 55 will now be described. For example, where the outer diameter D2 of the heat transfer member 57 for the stationary structure is made half the outer diameter D1 of the adjacent portion of the stationary structure 55 in the embodiment shown in FIG. 7, the effective heat conductivity k in the outer edge portion 55*b* of the stationary structure 55 is given by:

$$k = (k1 \cdot S1 + k2 \cdot S2)/(S1 + S2) \quad (1)$$
$$= (k1 \cdot (D1^2 - D2^2) + k2 \cdot D2^2)/D1^2$$

where k1 represents the heat conductivity of the stationary structure 55, which is 24 W/m·K in the case of SKD-11, S1 represents the lateral cross sectional area of the stationary structure 55, k2 represents the heat conductivity of the heat transfer member 57 for the stationary structure, which is 240 W/m·K, and S2 represents the lateral cross sectional area of the heat transfer member 57 for the stationary structure.

If the values of k1 and k2 are substituted in formula (1), the effective heat conductivity k is 78 W/m·K. It follows that the cooling effect in the case of using the heat transfer member 57 for the stationary structure is about 3.3 times as high as that in the case where the heat transfer member 57 for the stationary structure is not used.

The heat transfer effect in the bearing section will now be described. Suppose that the heat transfer member 56 for the rotor and the heat transfer member 57 for the stationary structure are not included in the X-ray tube shown in FIG. 7, and that these portions are made of a material equal to that of the inner cylinder 54*c*. In this case, the heat transfer is calculated as a solid column made of SKD-11 having a heat conductivity k of 24 W/m·K like the inner cylinder 54*c* and having an outer diameter D3. Also, where the heat transfer member 56 for the rotor is arranged to cover the outer circumferential surface of the inner cylinder 54*c* as shown in FIG. 7, the heat transfer is calculated on the basis that a heat transfer member for the rotor having an inner diameter D2 (=0.6×D3) and an outer diameter D3, said heat transfer member having a heat conductivity k2 of 240 W/m·K, is arranged to cover the outer circumferential surface of the inner cylinder 54*c*.

As in the case of the stationary structure, the effective heat conductivity k in the case where the heat transfer member 56 for the rotor is bonded to the inner cylinder 54*c* is:

$$k=(k2\cdot(D3^2-D2^2)+k1\cdot D2^2)/D3^2 \quad (2)$$

If the values of k1 and k2 are substituted in formula (2), the value of k is 162 W/m·K, supporting that it is possible to obtain a heat transmitting effect and a heat dissipating effect higher than those in the case where molybdenum (k=147 W/m·K) is used for forming the entire bearing section. It follows that the temperature in each portion of the bearing section can be made uniform more efficiently.

Where two kinds of materials are used in combination, the thermal stress σ generated in each material under high temperatures is represented by:

$$\sigma=E\cdot\Delta\alpha\cdot\Delta T$$

where E represents the Young's modulus, Δα represents the difference in thermal expansion coefficient between the two kinds of the materials, and ΔT represents the temperature difference from the room temperature.

Suppose the X-ray tube of the construction shown in FIG. 7 is operated under the temperature of about 220° C. (ΔT=200° C.), and the bearing is subjected to the vacuum degassing treatment at 750° C. (ΔT=730° C.). In this case, the problem of the thermal deformation does not take place if the thermal stress σ is smaller than the tensile strength of the materials at each temperature, making it possible to the combination of materials that permits sufficiently diminishing the value of Δα. For example, where SKD-11 is used as the bearing material, the problem of the thermal deformation can be resolved by selecting a composite material consisting of 65% by weight of tungsten and 35% by weight of copper as a high heat conductive material bonded to the bearing.

Figure 8:
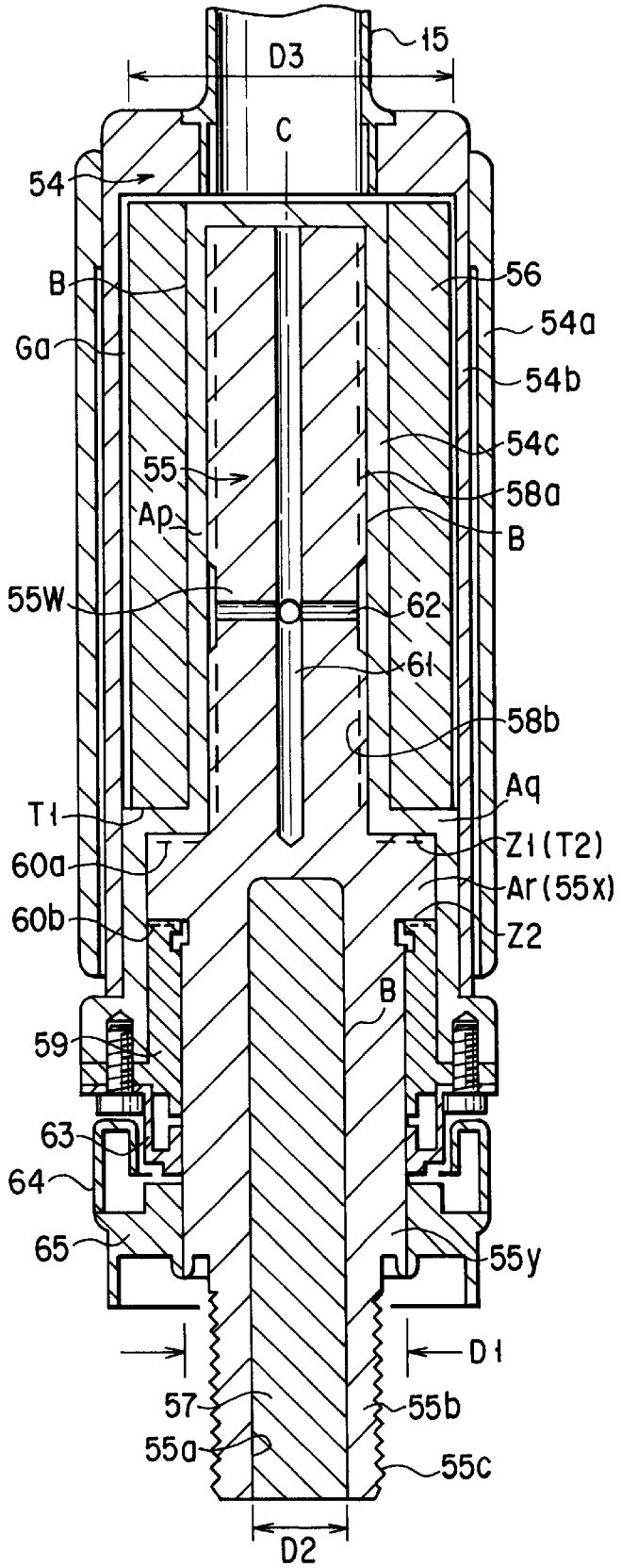
FIG. 8 is a vertical cross sectional view schematically showing in a magnified fashion a part of an X-ray tube of a rotary anode type according to another embodiment of the present invention.

FIG. 8 shows an X-ray tube according to another embodiment of the present invention. The embodiment shown in FIG. 8 resembles the embodiment shown in FIG. 7, except that the heat transfer member 56 for the rotor extends downward to reach a region close to the large diameter portion 55*x* of the stationary structure, and that the heat transfer member 57 for the stationary structure extends upward to reach the large diameter portion 55*x* of the stationary structure. Incidentally, the same constituents of the X-ray tube are denoted by the same reference numerals so as to avoid an overlapping description.

According to the embodiment shown in FIG. 8, it is possible to further improve the heat dissipating properties of the bearing section, compared with the embodiment shown in FIG. 7, while scarcely impairing the mechanical strength of the stationary structure.

Figure 9:
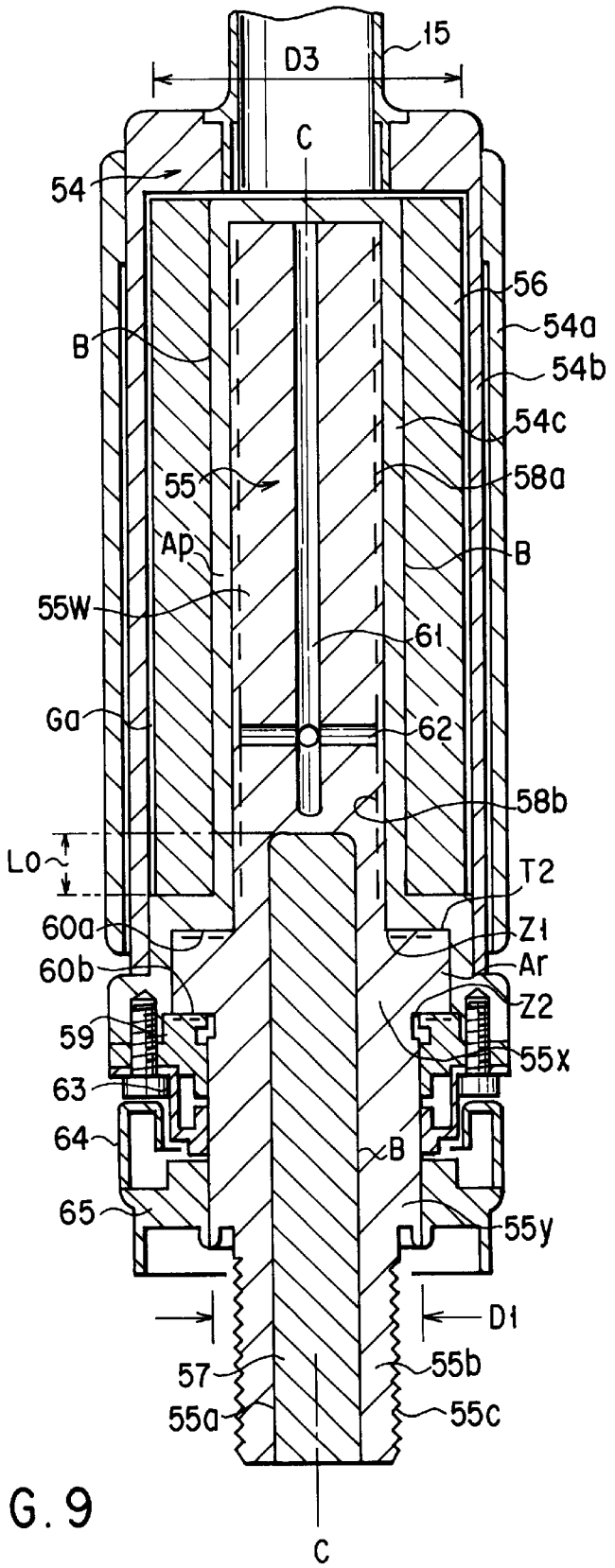
FIG. 9 is a vertical cross sectional view schematically showing in a magnified fashion a part of an X-ray tube of a rotary anode type according to another embodiment of the present invention.

FIG. 9 shows an X-ray tube according to another embodiment of the present invention. The embodiment shown in FIG. 9 resembles the embodiment shown in FIG. 8, except that the heat transfer member 57 for the stationary structure extends upward through the inner region of the large diameter portion 55*x* of the stationary structure so as to reach a region inside the lower portion of the heat transfer member 56 for the rotor. As result, the heat transfer member 56 for the rotor and the heat transfer member 57 for the stationary structure are positioned to substantially overlap each other over a distance Lo in the axial direction. Incidentally, the same constituents of the X-ray tube are denoted by the same reference numerals so as to avoid an overlapping description.

According to the embodiment shown in FIG. 9, it is possible to further improve the temperature distribution in the bearing section and to further improve the heat dissipation properties, compared with the embodiment shown in FIG. 8, because the heat transfer member 56 for the rotor and the heat transfer member 57 for the stationary structure are substantially allowed to partially overlap with each other in the embodiment shown in FIG. 9. In addition, the mechanical strength of the stationary structure is scarcely impaired in the embodiment shown in FIG. 9.

Figure 10:
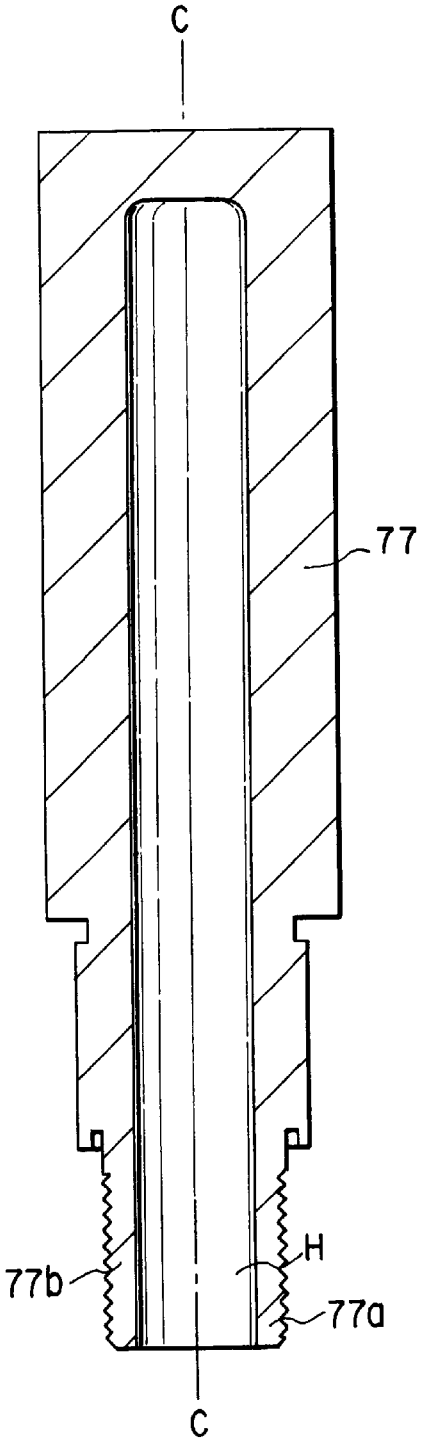
FIG. 10 is a vertical cross sectional view schematically showing a structure in a manufacturing step, which is formed as a stationary structure of an X-ray tube of a rotary anode type according to another embodiment of the present invention.
Figure 12:
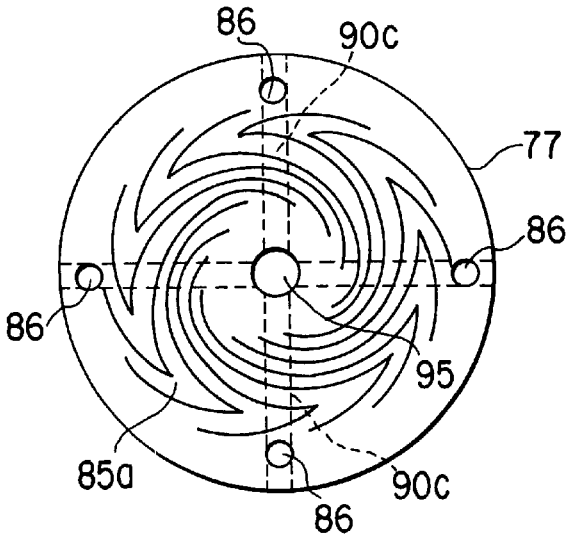
FIG. 12 is a plan view showing the upper surface of the stationary structure shown in FIG. 11.
Figure 11:
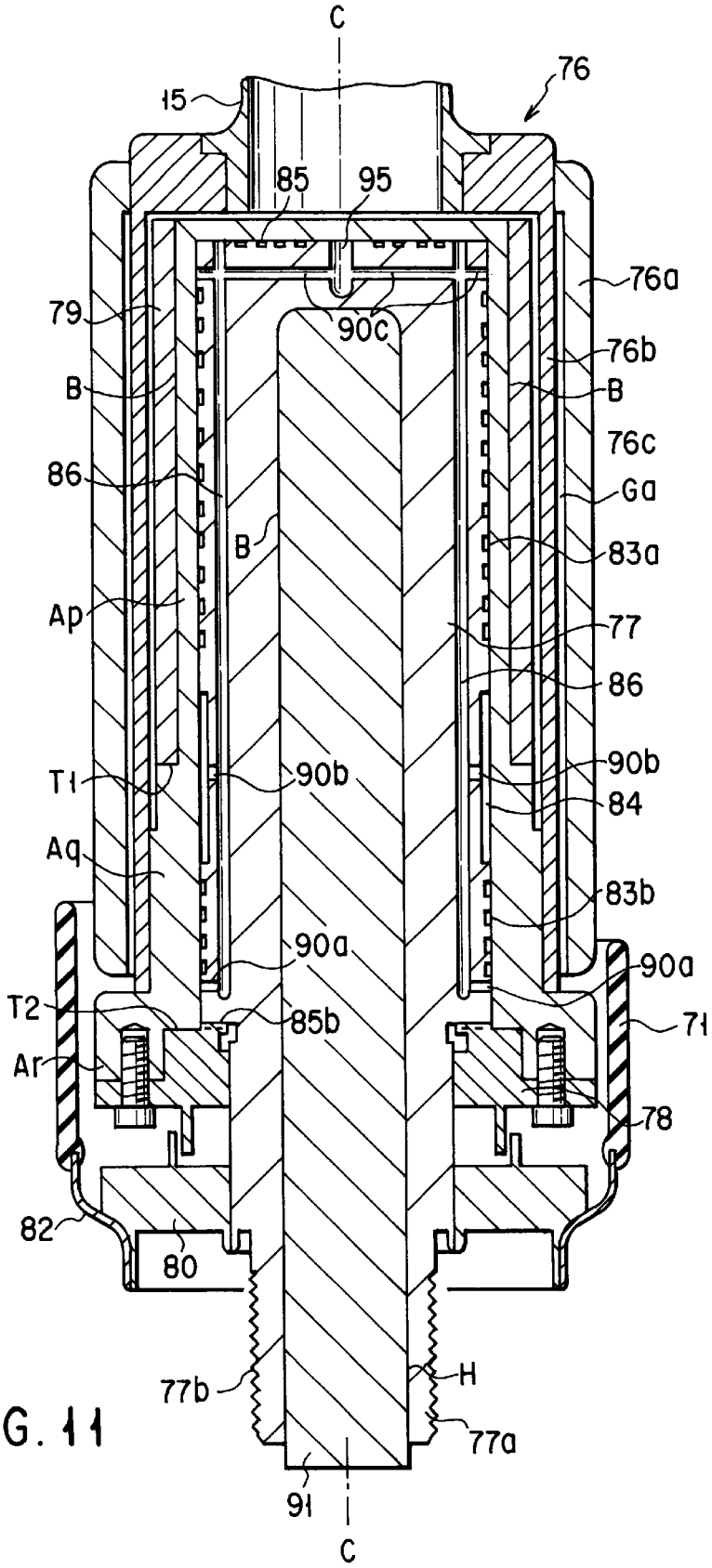
FIG. 11 is a vertical cross sectional view schematically showing in a magnified fashion a part of an X-ray tube of a rotary anode type according to another embodiment of the present invention.

FIGS. 10 to 12 collectively show an X-ray tube according to another embodiment of the present invention. In this embodiment, the support shaft 15 to which is fixed a disc-like rotary anode target (not shown) is joined to the intermediate cylinder 76*b* of the rotor 76. Also, the rotor 76 is of a three-layer structure consisting of the outer cylinder 76*a*, the intermediate cylinder 76*b* and the inner cylinder 76*c* having a bottom. The thrust ring 78 is fixed by screw engagement to the lower end opening of the inner cylinder 76*c*.

As in the embodiment described previously, the outer cylinder 76*a* of the rotor consists of a copper body having a black film attached to the outer circumferential surface. The intermediate cylinder 76*b* is made of the TNF material. Further, each of the inner cylinder 76*c* having a bottom and the thrust ring 78 is made of SKD-11.

The first stepped portion T1 is formed in a part of the outer circumferential surface of the inner cylinder 76*c* of the rotor, e.g., in a region in which a heat insulating space Ga is formed between the outer circumferential surface of the inner cylinder 76*c* and the intermediate cylinder 76*b*. The first portion Ap of the inner cylinder 76*c* positioned above the first stepped portion T1 is formed smaller in the outer diameter than the second portion Aq of the inner cylinder 76*c* positioned below the first stepped portion T1. A heat transfer member 79 for the rotor is bonded in a substantially cylindrical form by, for example, brazing to the outer circumferential portion of the first portion Ap having a smaller outer diameter. The thickness of the heat transfer member 79 for the rotor is determined to permit the outer circumferential surface of the heat transmitting member 79 to be aligned with the outer circumferential surface of the second portion Aq of the inner cylinder 76*c*. Incidentally, the heat transfer member 79 for the rotor is made of a material having a heat conductivity higher than that of the inner cylinder 76*c*. For example, the heat transfer member 79 is made of a composite material prepared by impregnating a tungsten sintered material with 35% by weight of copper.

The second stepped portion T2 is formed in a part of the inner circumferential surface of the inner cylinder 76*c* of the rotor, e.g., below the first stepped portion T1. The second portion Aq of the inner cylinder 76*c* positioned above the second stepped portion T2 is formed smaller in the inner diameter than the third portion Ar of the inner cylinder 76*c* positioned below the second stepped portion T2.

A substantially columnar stationary structure 77 is inserted into the inside of the inner cylinder 76*c* of the rotor in a manner to ensure a bearing clearance of about 20 $\mu$m during operation of the X-ray tube. The lower portion of the stationary structure 77 extends downward through the central hole of the thrust ring 78 so as to be fixed partly to the sealing metal ring 80 and further extends downward such that the outer edge portion 77*a* of the stationary structure is positioned outside the vacuum vessel 71. A male screw 77*b* is formed on the outer circumferential surface of the outer edge portion 77*a* of the stationary structure, and the X-ray tube of the rotary anode type is fixed to the housing (not shown) by utilizing the male screw 77*b*. The sealing metal ring 80 is hermetically welded to a sealing ring 82 made of a thin metal body and having one end fixed to the vacuum vessel 71. Also, the sealing metal ring 80 is hermetically welded to the stationary structure 77.

It should be noted that a hole H having a relatively large inner diameter is formed to extend upward from the lower surface of the outer edge portion 77*a* of the stationary structure positioned outside the vacuum vessel along the axis C of the X-ray tube. The upper end of the hole H is positioned close to the upper surface of the stationary structure 77.

Two sets of spiral grooves 83*a*, 83*b* are formed on the outer circumferential surface of the stationary structure 77 so as to form slide bearings of the dynamic pressure type in the radial direction. A recess 84 for storing a part of a liquid metal lubricant is formed in that region of the outer circumferential surface of the stationary structure 77 which is sandwiched between these two sets of spiral grooves 83*a* and 83*b*. Also, spiral grooves 85*a* and 85*b* are formed on the upper surface of the stationary structure 77 in contact with the bottom surface of the inner cylinder 76*c* on the side of the rotary anode target and on the upper surface of the thrust ring 78, respectively, so as to form slide bearings of the dynamic pressure type in the thrust direction.

Four lubricant storage chambers 86 each housing a liquid metal lubricant are arranged 90° apart from each other in the circumferential direction within the stationary structure 77 in a manner to avoid the hole H formed in the central portion of the stationary structure 77. The upper end of each of the lubricant storage chambers 86 is open in the upper end surface of the stationary structure 77. Four first lubricant passageways 90*a*, which communicate with the edge portions of the spiral grooves positioned below the spiral grooves 83*b* and with the bearing clearance, are formed to extend in the radial direction from the lower ends of the four lubricant storage chambers 86. Further, four second lubricant passageways 90*b* are formed to extend in the radial direction in that region of the stationary structure 77 which is positioned between the lubricant storage chambers 86 and the recesses 84 formed on the outer circumferential surface of the stationary structure 77. Still further, four third lubricant passageways 90*c*, which communicate with the lubricant storage chambers 86 and with a small hole having an opening 95 in the upper surface of the stationary structure 77, are formed to extend in the radial direction through the stationary structure 77 in a manner to avoid the hole H made in the stationary structure 77. It should be noted that the four lubricant chambers 86 are open in the outer circumferential region of the spiral pattern 85*a* having a circular herringbone pattern on the upper surface of the stationary structure 77, and the central opening 95 is positioned in the central portion in which the spiral grooves 85*a* are not formed.

A metal lubricant, which is in the form of a liquid during operation of the X-ray tube, e.g., a Ga—In—Sn alloy, is supplied to the lubricant storage chambers 86, the lubricant passageways 90*a*, 90*b*, 90*c*, the bearing clearance regions between the rotor 76 and the stationary structure 77, the recess 84 and the spiral grooves 83*a*, 83*b*.

As shown in FIG. 10, a columnar structure is prepared and the hole H is formed in the columnar structure along an axis thereof. A heat transfer member 91 for the stationary structure is inserted into the hole H of the columnar structure. Thereafter, the columnar structure is worked to provide the stationary structure shown in FIGS. 11 and 12. The heat transfer member 91 is integrally bonded by, for example, brazing to the inner surface of the hole H. The heat transfer member 91 is made of a material having a heat conductivity higher than that of the stationary structure 77. For example, the heat transfer member 91 is made of a composite material consisting of, for example, 65% by weight of tungsten and 35% by weight of copper.

According to the X-ray tube of the construction described above, the heat transfer member 91 for the stationary structure having a high heat conductivity and a large volume is inserted into a hole made in the central portion in the axial direction of the stationary structure 77 and is integrally bonded by, for example, brazing to the stationary structure 77. In addition, the heat transfer member 76*c* for the rotor and the heat transfer member 91 for the stationary structure are positioned to substantially overlap with each other over a relatively long distance in the axial direction. As a result, it is possible to make uniform the temperature in each bearing section and to obtain good heat transfer characteristics via the stationary structure. It follows that the heat in the bearing section can be dissipated efficiently to the outside of the tube, and it is possible to suppress the temperature elevation of the bearing section. What should also be noted is that, since the heat transfer member 91 for the stationary structure is engaged tight with the hole made in the stationary structure 77, it is possible to ensure a sufficiently high mechanical strength of the stationary structure 77.

Figure 13:
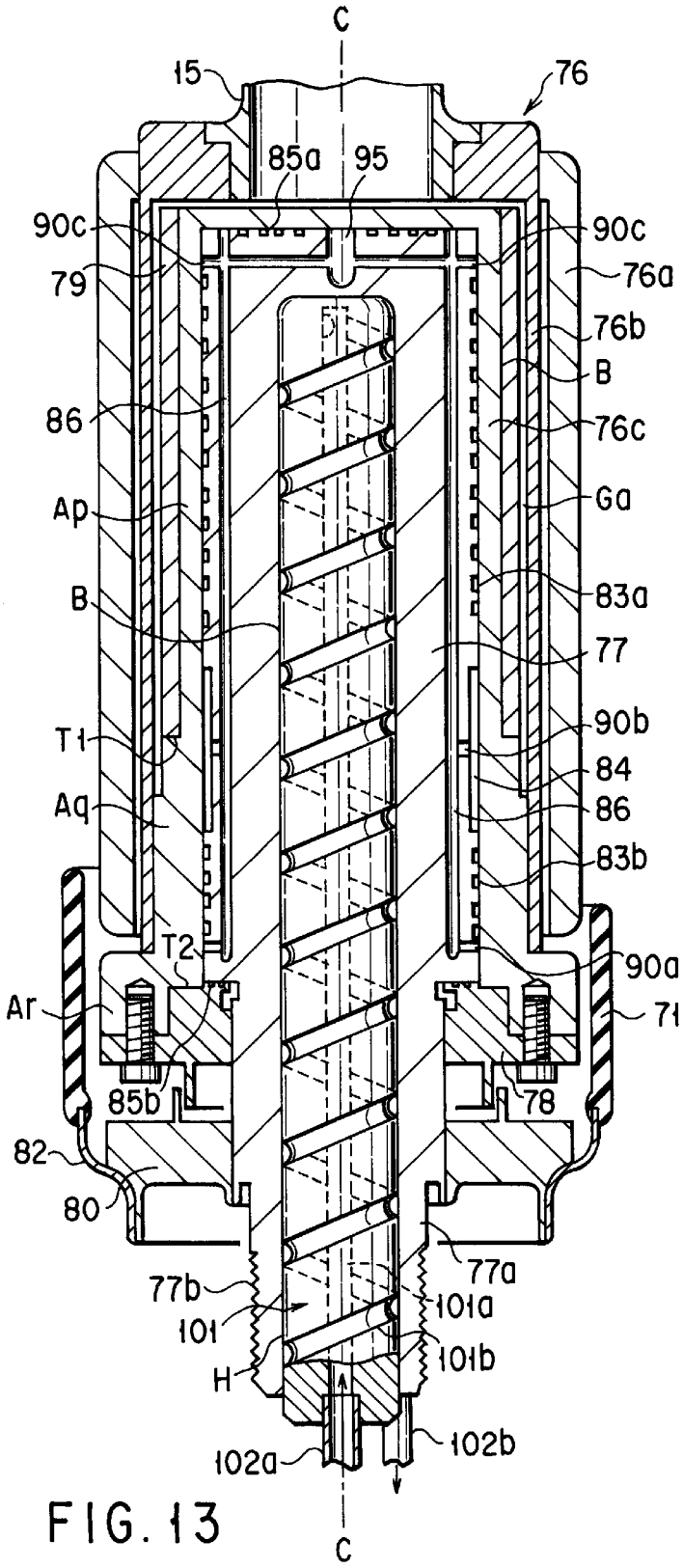
FIG. 13 is a vertical cross sectional view schematically showing in a magnified fashion a part of an X-ray tube of a rotary anode type according to another embodiment of the present invention.
Figure 14:
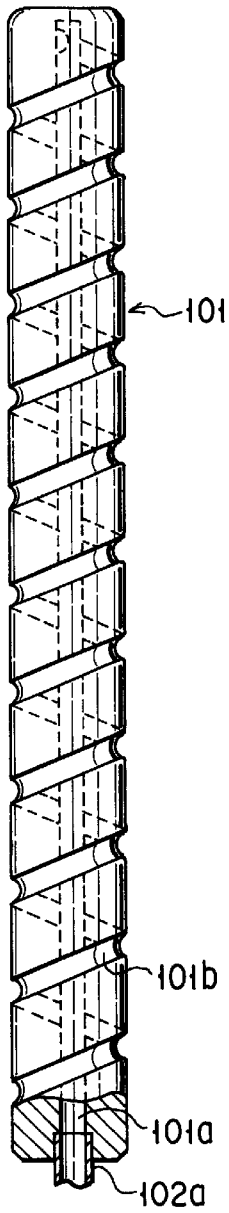
FIG. 14 is a side view showing a heat transfer member for the stationary structure of the X-ray tube of a rotary anode type shown in FIG. 13.

FIGS. 13 and 14 collectively show an X-ray tube according to another embodiment of the present invention. The constituents of the X-ray tube shown in FIGS. 13 and 14 and common with those of the X-ray tube shown in FIGS. 10 to 12 are denoted by the same reference numerals so as to avoid an overlapping description. In the embodiment shown in FIGS. 13 and 14, a heat transmitting member 101 made of a material having a heat conductivity higher than that of the inner cylinder 76*c*, e.g., a composite material consisting of 65% by weight of tungsten and 35% by weight of copper, is inserted into the hole H extending along the central portion of the stationary structure 77 and is integrally bonded by, for example, brazing to the inner surface of the hole H. It should be noted that a coolant passageway 101*a* is formed along the axis C of the heat transfer member 101 for the stationary structure. Also, a spiral coolant passageway 101*b* is formed on the outer circumferential surface of the heat transfer member 101 for the stationary member.

These coolant passageways 101*a* and 101*b* are joined to each other on the side of the upper end of the heat transfer member 101 for the stationary structure. Also, a pipe 102*a* for introducing a cooling medium such as an insulating oil and a pipe 102*b* for discharging the cooling medium are mounted to the lower ends of the coolant passageways positioned in the lowermost portion of the edge portion 77*a* positioned outside the vacuum vessel 71 and having a male screw 77*b*.

In the X-ray tube of the construction described above, a cooling medium is introduced through the pipe 102*a*. The cooling medium flows through the coolant passageway 101*a* and, then, through the spiral coolant passageway 101*b* positioned close to the bearing section formed between the inner surface of the hole H of the stationary structure 77 and the heat transfer member 101 for the stationary structure 77. Finally, the cooling medium is discharged to the outside through the pipe 102*b*. In this case, the heat in the bearing section is dissipated to the outside through the heat transfer member 101 itself for the stationary structure and through the cooling medium flowing through the coolant passageways. As a result, the temperature elevation of the bearing section can be further suppressed. Also, since the heat transfer member 101 for the stationary structure is engaged tight with and bonded integrally to the hole of the stationary structure 77, it is possible to ensure a sufficiently high mechanical strength of the stationary structure 77.

The heat transfer member 101 for the stationary structure before insertion into the hole H of the stationary structure 77 is processed in advance as shown in FIG. 14. Specifically, the linear coolant passageway 101*a* is formed to extend along the axis of the heat transfer member 101, followed by forming the spiral coolant passageway 101*b* on the outer circumferential surface of the heat transfer member 101. Incidentally, it is possible for the material of the heat transfer member 101 for the stationary structure to be equal to the material of the stationary structure 77.

Figure 15:
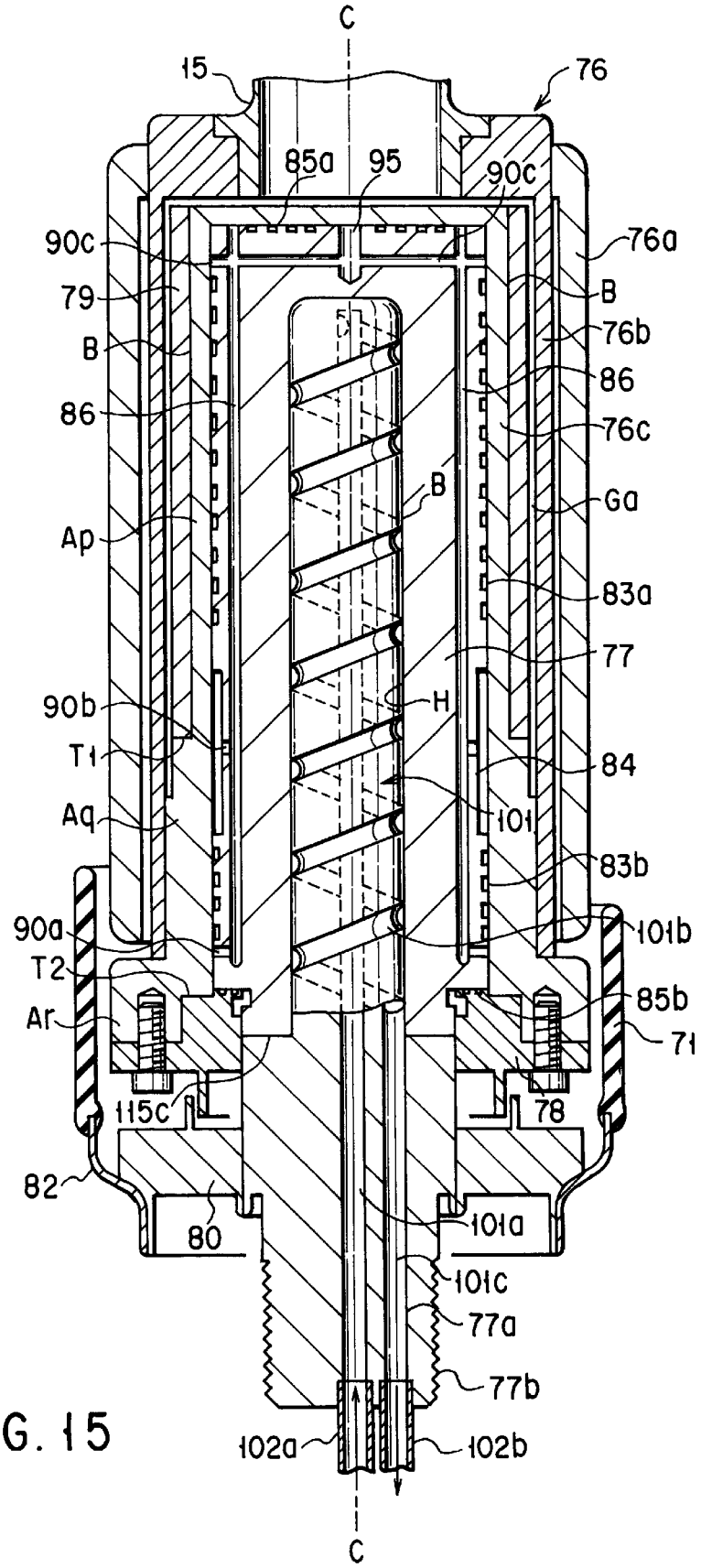
FIG. 15 is a vertical cross sectional view schematically showing in a magnified fashion a part of an X-ray tube of a rotary anode type according to another embodiment of the present invention.

FIG. 15 shows an X-ray tube according to another embodiment of the present invention. The X-ray tube shown in FIG. 15 is substantially equal in construction to the X-ray tube shown in FIGS. 13 and 14, except that, in the embodiment shown in FIG. 15, the heat transfer member 101 for the stationary structure equipped with the coolant passageways is made integral with the outer edge portion of the stationary structure. The constituents of the X-ray tube shown in FIG. 15 and common with those of the X-ray tube shown in FIGS. 13 and 14 are denoted by the same reference numerals so as to avoid an overlapping description.

In the transfer member 101 for the stationary structure included in the embodiment shown in FIG. 15, the portion inserted into the hole H made in advance in the stationary structure 77 and the portion forming the outer edge portion 77*a* of the stationary structure are made integral, and a stepped portion in which the diameter of the heat transfer member 101 is changed is formed in the position inside the thrust ring 78. The spiral coolant passageway 101*b* is formed on the outer circumferential surface of the small diameter portion above the stepped portion. Also, a linear coolant passageway 101*c* communicating with the spiral coolant passageway 101*b* and the linear coolant passageway 101*a* are formed in parallel in the portion forming the outer edge portion 77*a* of the stationary structure.

The small diameter portion of the heat transfer member 101 for the stationary structure is tightly inserted into the hole H of the stationary structure 77, and the heat transfer member 101 abuts against the stepped surface on the lower surface of the inner portion of the thrust ring 78. Also, the heat transfer member 101 is integrally bonded to the stationary structure 77 by, for example, brazing or a friction welding. Incidentally, it is desirable for the bonding surface 115*c* of the stepped portion to be allowed to exhibit a sufficiently high bonding strength under high temperatures by the friction welding and for the outer edge portion 77*a* of the stationary structure to be capable of stably fixing the X-ray tube to the housing.

According to the embodiment shown in FIG. 15, the heat in the bearing section can be more efficiently dissipated to the outside by the heat transfer member 101 for the stationary structure. In addition, the heat transfer member 101 permits maintaining a sufficiently high mechanical strength of the X-ray tube. Particularly, since the coolant passageways 101*a*, 101*c* formed in the outer edge portion 77*a* of the stationary structure, which is apart from the bearing section, are formed straight, the flow resistance of the cooling medium is diminished so as to increase the heat dissipating function performed by the cooling medium.

Figure 16:
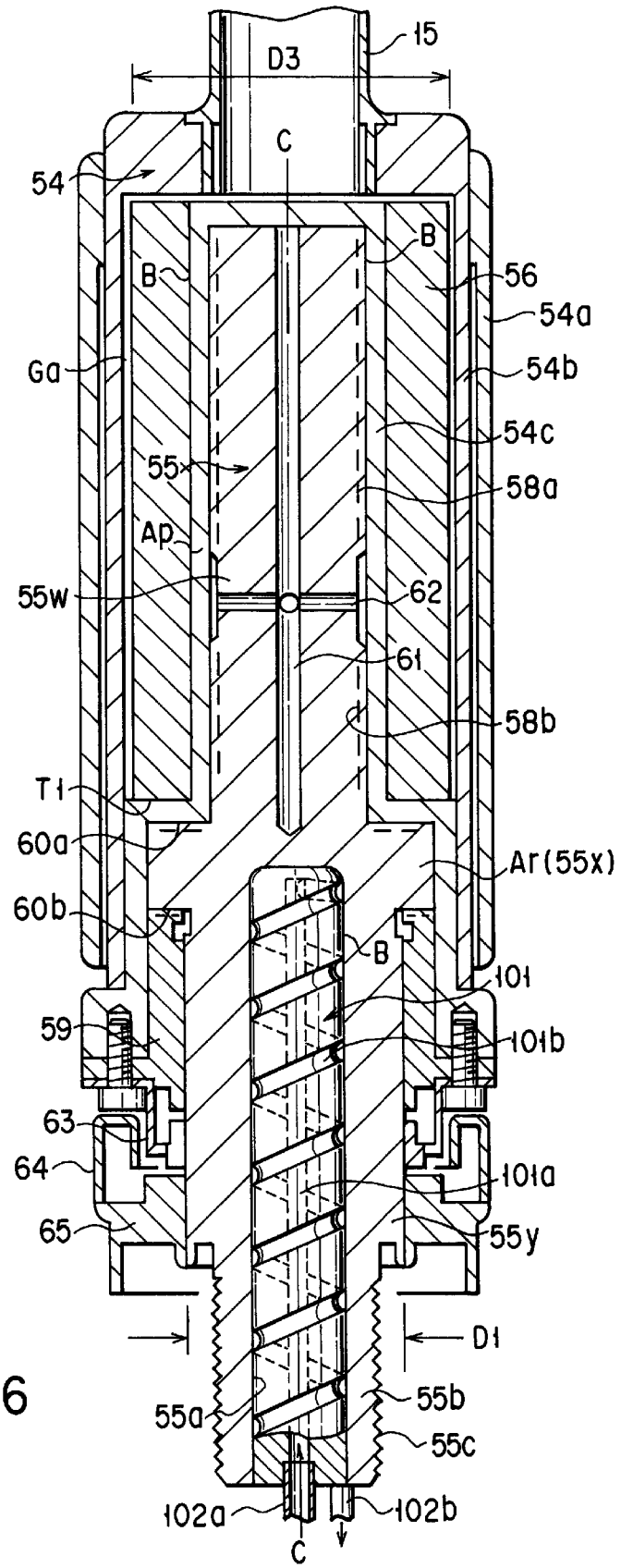
FIG. 16 is a vertical cross sectional view schematically showing in a magnified fashion a part of an X-ray tube of a rotary anode type according to another embodiment of the present invention.

FIG. 16 shows an X-ray tube according to another embodiment of the present invention. The embodiment shown in FIG. 16 is substantially equal in construction to the embodiment shown in FIG. 8, except that, in the embodiment shown in FIG. 16, a columnar heat transfer member 101 equipped with the coolant passageways 101*a* and 101*b*, which constitutes the heat transfer member for the rotor, is inserted into and bonded by, for example, brazing to a hole 55*a* of the stationary structure. The upper end of the columnar heat transfer member 101 extends to reach an inside region of the large diameter portion 55*x* of the stationary structure, i.e., to reach a position relatively close to the heat transfer member 56 for the rotor, so as to be fixed to the stationary structure 77. Incidentally, the constituents of the X-ray tube shown in FIG. 16, which are equal to the constituents of the X-ray tube shown in FIG. 8, are denoted by the same reference numerals so as to avoid an overlapping description.

According to the embodiment shown in FIG. 16, it is possible to improve the heat dissipating properties of the bearing section while scarcely impairing the mechanical strength of the stationary structure.

Figure 17:
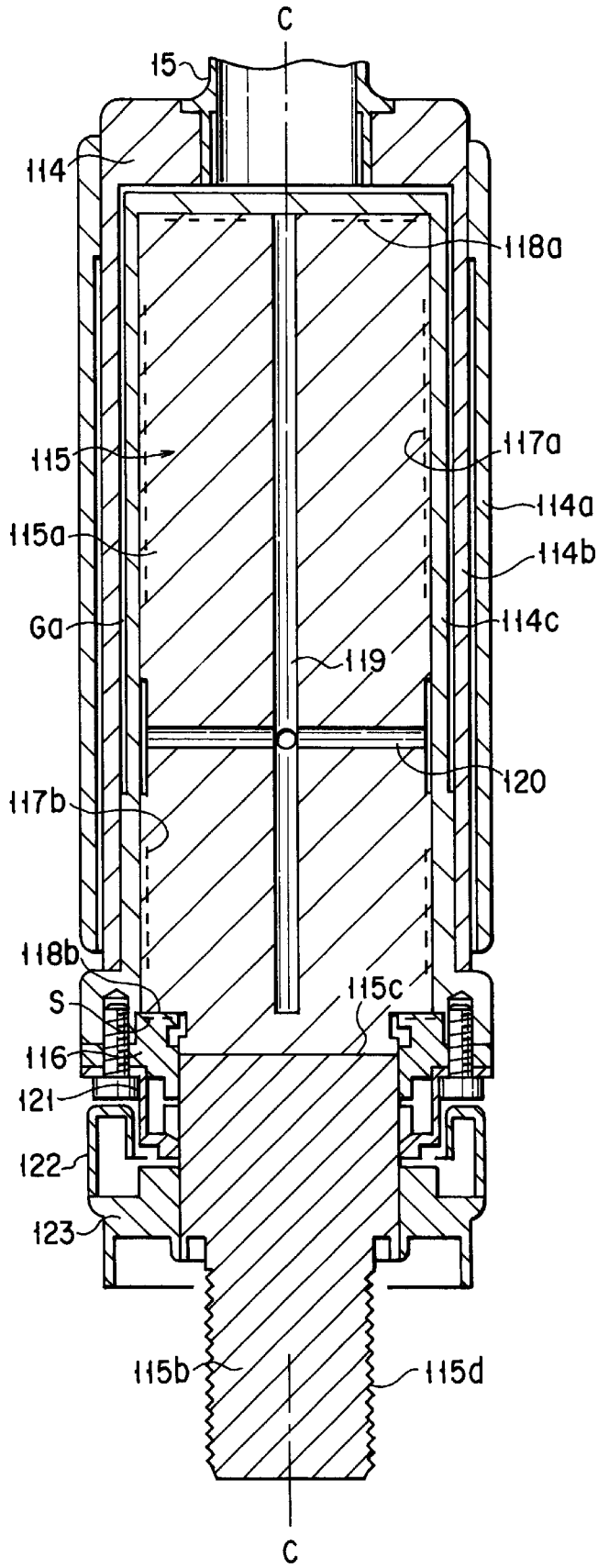
FIG. 17 is a vertical cross sectional view schematically showing in a magnified fashion a part of an X-ray tube of a rotary anode type according to another embodiment of the present invention.

FIG. 17 shows an X-ray tube according to another embodiment of the present invention. In this embodiment, the support shaft 15 to which is fixed a disc-like rotary anode target is joined to the rotor 114. The rotor 114 is of a three-layer structure consisting of, for example, an outer cylinder 114*a*, an intermediate cylinder 114*b*, and an inner cylinder 114*c* having a bottom. As in the embodiment described previously, the outer cylinder 114*a* is formed of a copper body having a black film attached to the outer circumferential surface. The intermediate cylinder 114*b* is made of a TNF material. Further, the inner cylinder having a bottom is made of KSD-11.

A columnar stationary structure 115 is inserted into the inner space of the rotor 114 with a small bearing clearance formed between the stationary structure 114 and the rotor 114. The stationary structure 115 consists of two portions, i.e., a first stationary structure portion 115*a* positioned on the side of the rotary anode target (not shown) and a second stationary structure portion 115*b* having a slightly smaller diameter and positioned below the first stationary structure portion 115*a*. The first stationary structure portion 115*a* is made of a material adapted for the bearing such as SKD-11. Also, the second stationary structure portion 115*b* is made of a material having a heat conductivity higher than that of SKD-11. For example, the second stationary structure portion 115*b* is made of a low carbon steel containing, for example, 0.5% of carbon. The second stationary structure portion 115*b* has an outer edge portion having a male screw 115*d* formed on the outer circumferential surface.

A stepped section S is formed in the first stationary structure portion 115*a* along the upper surface of a thrust ring 115 that is fixed by screw engagement to the lower end open portion of the rotor 114. The stationary structure portion 115*a* and the second stationary structure portion 115*b* are bonded to each other in the bonding plane 115*c* positioned inside the thrust ring 116 by a pressure bonding under high temperatures such as a friction welding, a butt resistance welding such as a flash welding, or a brazing method.

Spiral grooves 117*a*, 117*b* are formed in upper and lower regions on the outer circumferential surface of the first stationary structure portion 115*a* of the stationary structure 115 so as to form slide bearings of a dynamic pressure type between the stationary structure 115 and the rotor 114. Also, spiral grooves 118*a* and 118*b* are formed on the upper surface facing the inner cylinder 114*c* of the first stationary structure portion 115*a* and on the upper surface of the thrust ring 116 in contact with the surface of the stepped portion S, respectively, so as to form slide bearings of the dynamic pressure type between these spiral grooves and the rotor 114.

A lubricant storage chamber 119 for housing a liquid metal lubricant is formed in the central portion of the first stationary structure portion 115*a* of the stationary structure 115 in a manner to extend downward along the axis C of the X-ray tube from the upper surface of the stationary structure 115. Arranged between the lubricant storage chamber 119 and the slide bearing of the dynamic pressure type are, for example, four lubricant passageways 120 radially arranged 90° apart from each other in the circumferential direction. As a result, the liquid metal lubricant housed in the lubricant storage chamber 119 is supplied to the bearing sections of the dynamic pressure type through the lubricant passageways 120, etc.

In order to prevent the liquid metal lubricant from leaking to the vacuum side, a first trap ring 121 joined to the rotary portion and a second trap ring 122 joined to the stationary portion are arranged annular in a manner to surround the second stationary structure portion 115*b* in the lower portion of the thrust ring 116 in the drawing. The second trap ring 122 is fixed to a metal ring 123. Also, the second stationary structure portion 115*b* of the stationary structure 115 is hermetically welded to the portion of the metal ring 123 and extends to the further outer portion thereof.

According to the embodiment shown in FIG. 17, a slide bearing of a dynamic pressure type in the radial direction and a slide bearing of a dynamic pressure type in the thrust direction are mounted to the first stationary structure portion 115*a*. Since the first stationary structure portion 115*a* is made of, for example, SKD-11, it is possible to form a slide bearing of a dynamic pressure type having a high heat conductivity, making it possible to obtain good heat dissipating characteristics and to suppress the temperature elevation of the bearing section.

Where the mechanical load received by the stationary structure 115 is relatively small, it is possible to use a pure iron as a material of the second stationary structure portion 115*b*. In the case of using a pure iron, it is possible to obtain a large effect of suppressing the temperature in the bearing section, compared with the use of a low-carbon steel.

Figure 18:
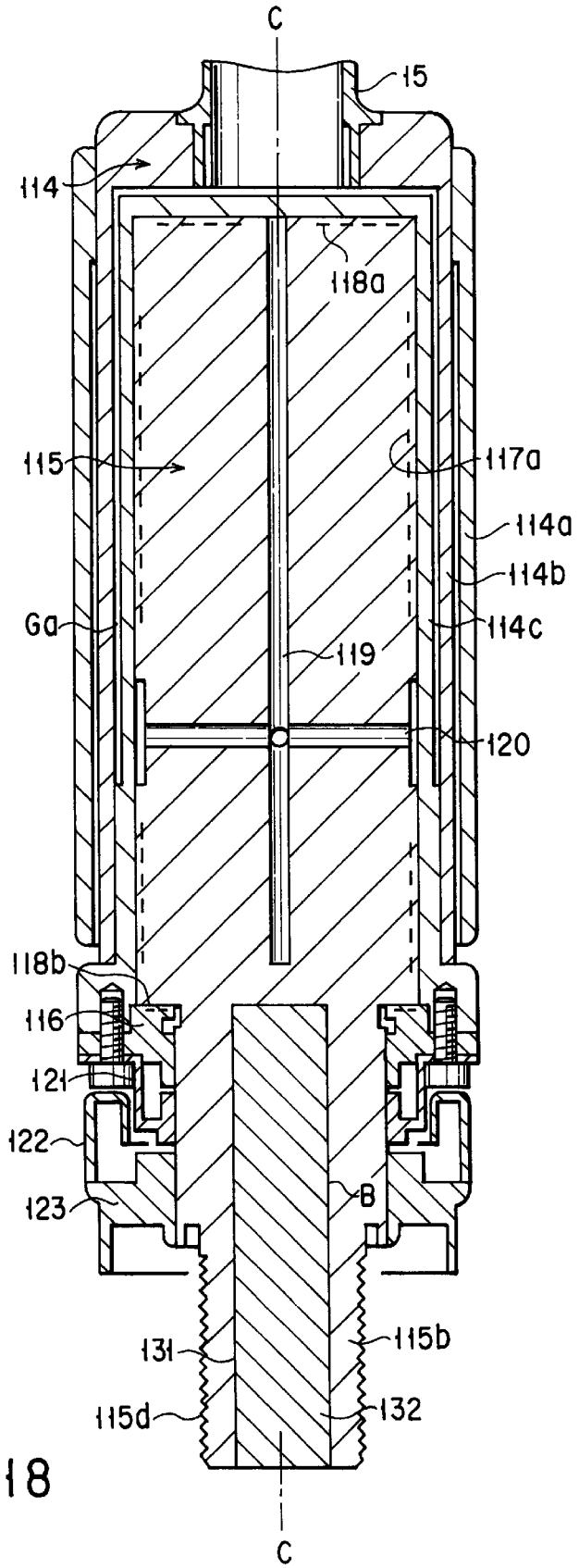
FIG. 18 is a vertical cross sectional view schematically showing in a magnified fashion a part of an X-ray tube of a rotary anode type according to another embodiment of the present invention.

FIG. 18 shows an X-ray tube according to another embodiment of the present invention. The embodiment shown in FIG. 18 is substantially equal in construction to the embodiment shown in FIG. 17, except that, in the embodiment shown in FIG. 18, a hole 131 having a large inner diameter is formed on the side of the outer edge portion 115*b* of the stationary structure 115 in a manner to extend upward to reach a region conforming with the upper edge portion of the thrust ring 116, and that a columnar heat transfer member 132 for the stationary structure, which is made of a material having a heat conductivity higher than that of the stationary structure 115, is tightly inserted into the hole 131. The heat transfer member 132 is integrally bonded to the inner surface of the hole 131 by means of, for example, brazing. Those constituents of the X-ray tube shown in FIG. 18 which correspond to those of the X-ray tube shown in FIG. 17 are denoted by the same reference numerals so as to avoid an overlapping description. According to the embodiment shown in FIG. 18, the bearing section is enabled to exhibit good heat dissipating characteristics with a relatively simple construction.

The heat transfer member 132 for the stationary structure can be formed of a low-carbon steel or a pure iron as well as an optional material selected from the group consisting of nickel, a nickel alloy, copper, a copper alloy, molybdenum, a molybdenum alloy, tantalum, a tantalum alloy, tungsten and a tungsten alloy. Where the heat transfer member 132 is made of, for example, copper, it is possible to obtain a greater effect of decreasing the temperature of the bearing section because copper has a high heat conductivity.

Figure 19:
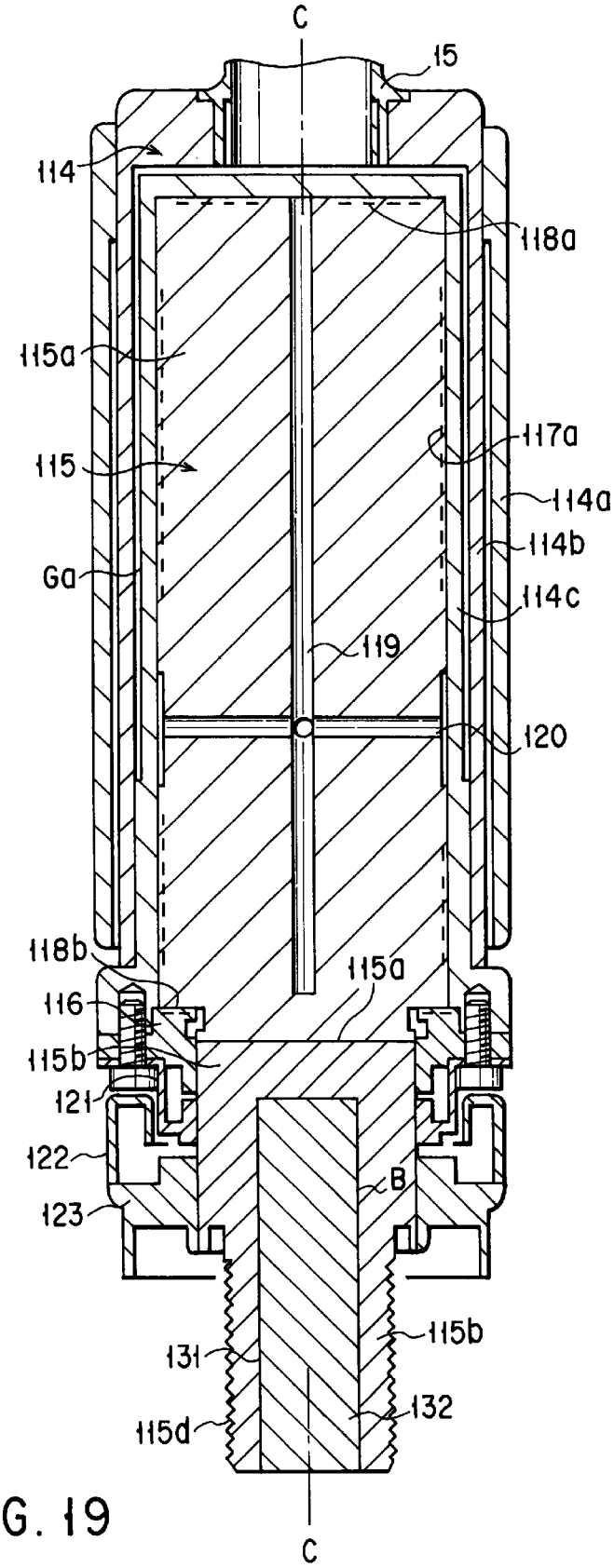
FIG. 19 is a vertical cross sectional view schematically showing in a magnified fashion a part of an X-ray tube of a rotary anode type according to another embodiment of the present invention.

FIG. 19 shows an X-ray tube according to another embodiment of the present invention. The embodiment shown in FIG. 19 is substantially equal in construction to the embodiment shown in FIG. 17, except that, in the embodiment shown in FIG. 19, a hole 131 having a large inner diameter is formed in the outer edge portion 115*b* of the stationary structure, which is made of another material and bonded to the main portion of the stationary structure 115, in a manner to extend upward to reach a region conforming with the upper edge portion of the thrust ring 116, and that a columnar heat transfer member 132 for the stationary structure, which is made of a material having a heat conductivity higher than that of the outer edge portion 115*b* of the stationary structure, is tightly inserted into the hole 131. The heat transfer member 132 is integrally bonded to the inner surface of the hole 131 by means of, for example, brazing. Those constituents of the X-ray tube shown in FIG. 18 which correspond to those of the X-ray tube shown in FIG. 17 are denoted by the same reference numerals so as to avoid an overlapping description.

According to the embodiment shown in FIG. 19, the first stationary structure portion 115*a* positioned on the side of the rotary anode target of the stationary structure 115 is made of, for example, KSD-11, the second stationary structure portion 115*b* is made of, for example, a low-carbon steel containing 0.5% of carbon, and the heat transfer member 132 for the stationary structure is made of copper or a copper alloy. Because of the particular construction, the second stationary structure portion 115*b* permits producing a prominent effect of lowering the temperature of the bearing section. The heat transfer member 132 for the stationary structure, which is fitted into the second stationary structure portion 115*b*, also produces a prominent temperature lowering effect. It follows that the effect of lowering the temperature of the bearing section is further promoted.

Figure 20:
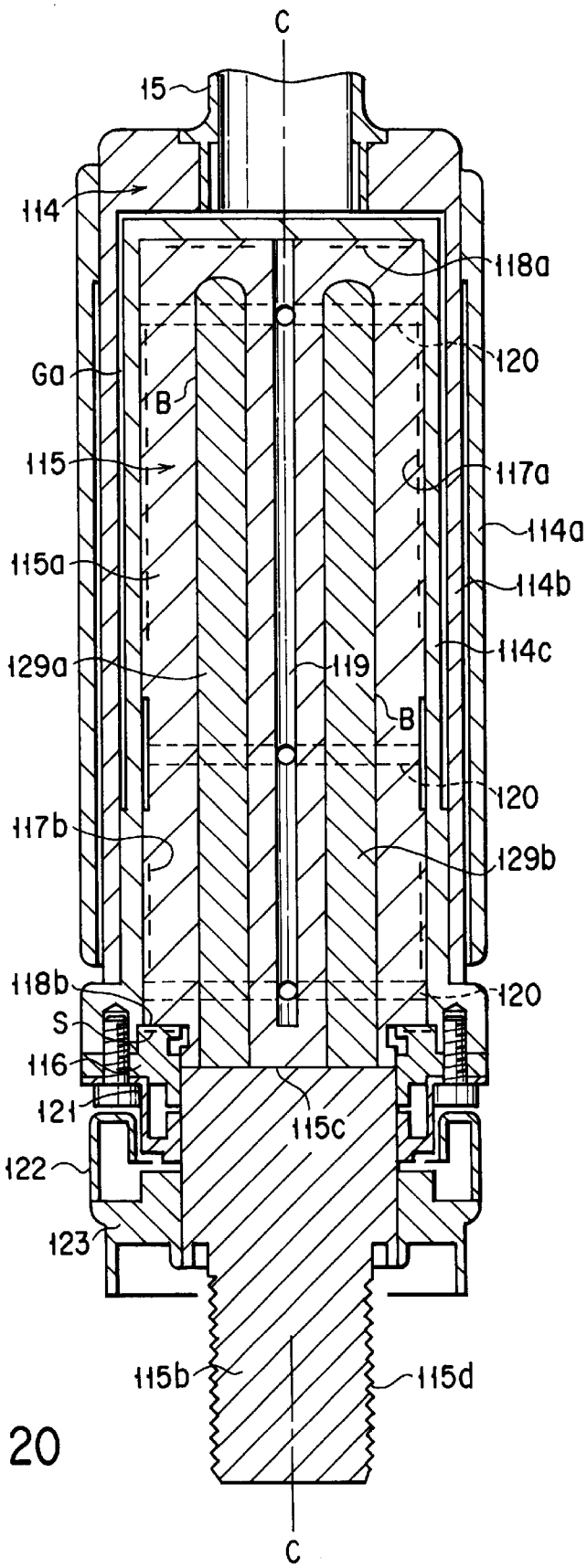
FIG. 20 is a vertical cross sectional view schematically showing in a magnified fashion a part of an X-ray tube of a rotary anode type according to another embodiment of the present invention.

FIG. 20 shows an X-ray tube according to another embodiment of the present invention. The embodiment shown in FIG. 20 is substantially equal in construction to the embodiment shown in FIG. 17, except that, in the embodiment shown in FIG. 20, for example, four rod-like members 129*a* having a high heat conductivity are inserted into the first stationary structure portion 115*a* so as to form an integral structure. Those constituents of the X-ray tube shown in FIG. 20 which correspond to those of the X-ray tube shown in FIG. 17 are denoted by the same reference numerals so as to avoid an overlapping description.

In the embodiment shown in FIG. 20, the four rod-like members 129*a*, 129*b* having a high heat conductivity are formed in positions avoiding the lubricant storage chamber 119 formed in the central portion of the stationary structure and lubricant passageways 120 radially extending from the lubricant storage chamber 119. The upper end portions of these rod-like members 129*a*, 129*b* are positioned close to the upper surface of the stationary structure, and the lower ends of these rod-like members 129*a*, 129*b* bonded in terms of the heat transfer to the upper bonding surface 115*c* of the second stationary structure portion 115*b*. As a result, the heat in each of the bearing sections is efficiently transferred to the outer edge portion 115*b* of the stationary structure so as to be dissipated to the outside.

Incidentally, in each of the embodiments shown in FIGS. 17 to 20, it is possible to bond a heat transfer member for the rotor similar to that used in the embodiment shown in FIGS. 2 to 4B to the outer circumferential surface of the inner cylinder 114 of the rotor.

Figure 21:
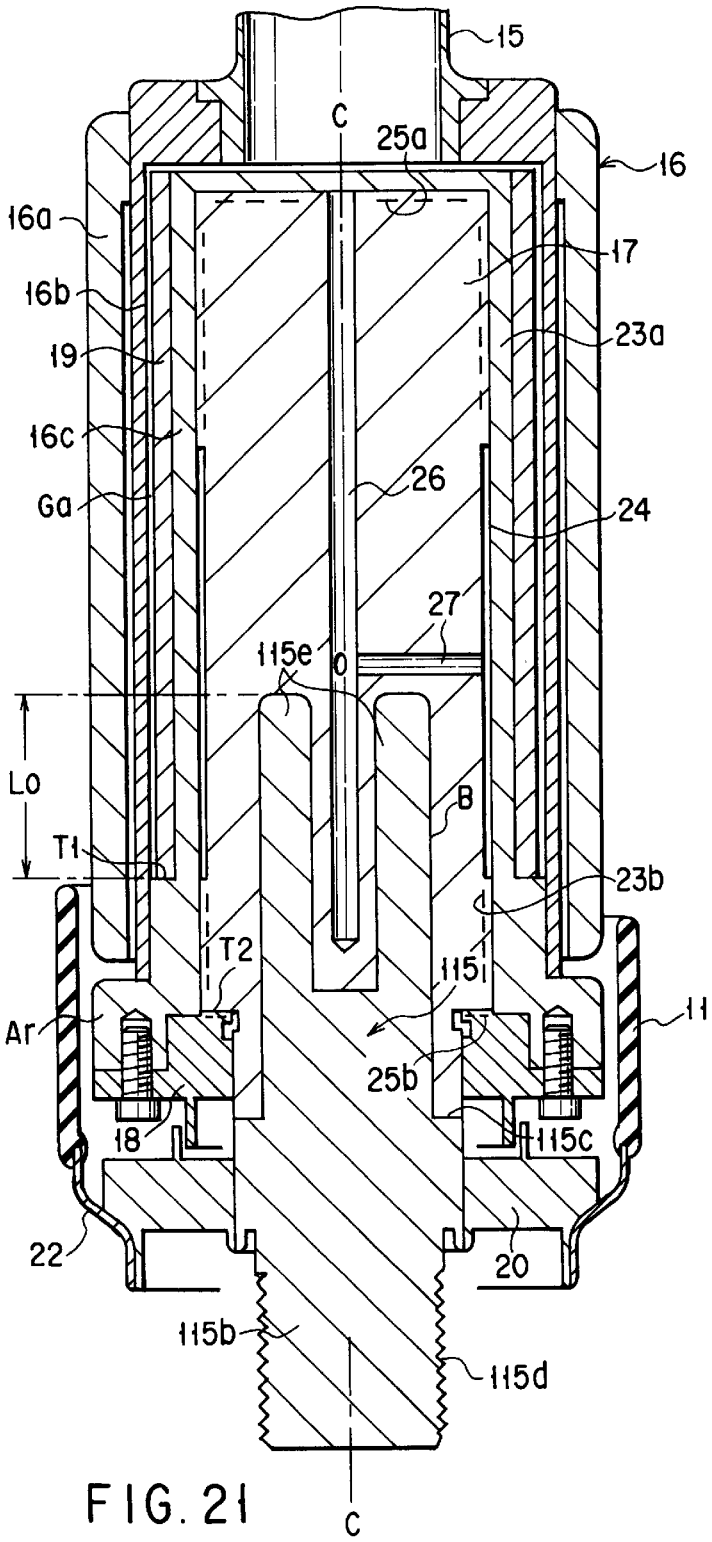
FIG. 21 is a vertical cross sectional view schematically showing in a magnified fashion a part of an X-ray tube of a rotary anode type according to still another embodiment of the present invention.
Figure 22:
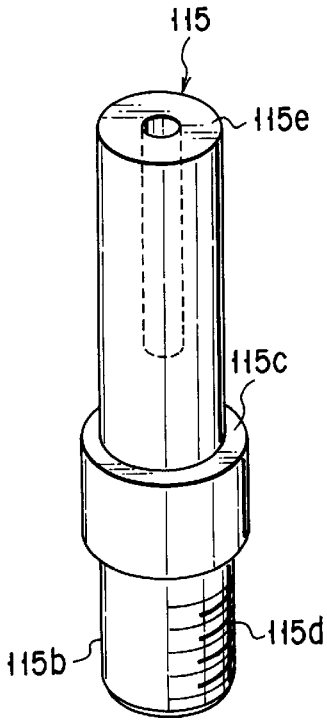
FIG. 22 is an oblique view schematically showing in a magnified fashion the stationary structure of the X-ray tube of a rotary anode type shown in FIG. 21.

Further, FIGS. 21 and 22 collectively show an X-ray tube according to still another embodiment of the present invention. The embodiment shown in FIGS. 21 and 22 is substantially equal in construction to the embodiment shown in FIGS. 2 to 4B, except that, in the embodiment shown in FIGS. 21 and 22, a heat transfer member 115 for the stationary structure having a cylindrical portion 115*e* is integrally bonded to the stationary member 17 constituting a bearing section. Incidentally, those constituents of the X-ray tube shown in FIGS. 21 and 22 which correspond to those of the X-ray tube shown in FIGS. 2 to 4B are denoted by the same reference numerals so as to avoid an overlapping description.

In the embodiment shown in FIGS. 21 and 22, the cylindrical portion 115*e* of the heat transfer member 115 for the stationary structure overlaps with the lower portion of the heat transfer member 19 for the rotor over a length Lo in the axial direction of the X-ray tube. Also, the heat transfer member 115 for the stationary structure is formed in a position avoiding the lubricant storage chamber 119 formed in the central portion of the stationary structure and the lubricant passageways 120 extending from the lubricant storage chamber 119 in radial directions. The particular construction makes the temperature in the bearing section uniform and exhibits an excellent heat dissipating performance.

According to each of the embodiments described above, the temperature in the bearing section is made uniform and the temperature elevation in the bearing section can be suppressed. It is also possible to suppress the undesired reaction between the member constituting the bearing surface and the liquid metal lubricant, the change in size of the spiral groove or the bearing clearance, the gas release, and the leakage of the lubricant. As a result, stable rotating characteristics can be maintained over a long period of time with respect to the input of a high load to the anode target. It should also be noted that the heat transferred to the bearing section and generated in the bearing section itself can be promptly dissipated to the outside of the X-ray tube so as to suppress the temperature elevation in the bearing section. It follows that it is possible to prevent the bearing surface from reacting with the liquid metal lubricant so as to bring about changes in the size of the spiral groove and the bearing clearance, with the result that stable rotating characteristics can be maintained over a long period of time. Also, the technical idea of the present invention can be applied to a relatively high speed rotation.

Particularly, where a hole is made in the stationary structure in a manner to extend upward from the outer edge portion of the stationary structure and a heat transfer member for the stationary structure is inserted in and bonded to the hole, the X-ray tube of a high quality can be manufactured easily with a low manufacturing cost. Also, it is possible to arrange the heat transfer member for the stationary structure in a position avoiding the lubricant storage chamber and the hole for the lubricant passageway performing an effective function in the exhausting step in the manufacturing process and in the degassing step of the bearing structure section. Also, it is more desirable to set the outer diameter of the heat transfer member for the stationary structure arranged in the stationary structure portion not to exceed half the outer diameter of that portion of the stationary structure which surrounds the heat transfer member for the stationary structure because the mechanical strength of the stationary structure is scarcely lowered in this case.

In each of the embodiments described above, each of the heat transfer member for the stationary structure, the heat transfer member for the rotor, and the edge portion of the stationary structure is made of copper or a composite material consisting of 65% by weight of tungsten and 35% by weight of copper. It should be noted in this connection that a steel material has a thermal expansion coefficient falling within a range of between $9\times10^{-6}$/° C. and $13\times10^{-6}$/° C. Therefore, in the case of using another steel material as the bearing material, it is possible to use a composite material of tungsten and copper, if the copper content is selected to fall within a range of between 20% by weight and 50% by weight.

It is also possible to prepare the composite material used in the present invention by impregnating the pores of a sintered material containing at least one metal selected from the group consisting of molybdenum, a molybdenum alloy, tantalum, a tantalum alloy, tungsten, a tungsten alloy and tungsten carbide with a metallic material containing at least one of copper and silver, by dispersing in a metallic material containing at least one of copper and silver a ceramic material that does not form a solid solution with the metallic material, or by combining a metallic material of at least one of copper and silver with graphite.

It is also possible to use at least one material selected from the group consisting of copper, a copper alloy, aluminum, an aluminum alloy, magnesium, a magnesium alloy, a silver alloy and a carbon fiber-reinforced carbon composite material (C/C material) in place of the composite material described above. Incidentally, in order to achieve a good heat transfer, it is desirable for the heat transfer member of any construction to have a heat conductivity of at least 100 W/m·K.

Also, in some of the embodiments described above, a heat transfer member for the rotor is bonded to the outer circumferential surface of the inner cylinder constituting the rotor and, at the same time, the heat transfer member for the stationary structure is bonded to the inner surface of a hole made in the edge portion of the stationary structure. In this case, it is possible to arrange in the X-ray only one of the heat transfer member for the rotor and the heat transfer member for the stationary structure. However, a greater heat dissipating effect can be obtained in the case of arranging both the heat transfer member for the rotor and the heat transfer member for the stationary structure, as already described.

Also, in the embodiments described above, employed is a so-called "cantilever bearing structure" in which the bearing is supported at the edge portion on one side alone of the stationary structure. However, the technical idea of the present invention can also be applied to a so-called "double supported bearing structure" in which the both edge portions of the stationary structure are supported by, for example, the vacuum vessel.

Also, in the embodiments described above, brazing is mainly employed for bonding the heat transfer member for the rotor to the outer circumferential surface of the inner cylinder constituting the rotor or for bonding the heat transfer member for the stationary structure to the inner surface of the hole made in the stationary structure. However, it is also possible to employ, for example, a friction welding, a diffusion welding, welding or soldering, adhesion with an adhesive or a partial combination of the suitable bonding methods exemplified above in addition to the brazing.

As described above, the present invention provides an X-ray tube of a rotary anode type that permits making uniform the temperature and suppressing the temperature elevation in the bearing section of a dynamic pressure type and also permits maintaining stable rotation characteristics over a long period of time.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An X-ray tube of a rotary anode type, comprising:

a disc-like rotary anode for emitting an X-ray upon irradiation with an electron beam;

a cylindrical rotor mechanically joined to said rotary anode;

a columnar stationary structure having an axis, inserted into the inner space of said rotor and provided with a lubricant storage chamber formed in said stationary structure along the axis thereof, and a hole formed in said stationary structure and extending along the axis thereof;

a slide bearing of a dynamic pressure type formed between the rotor and the stationary structure and having a metal lubricant, which is in the form of a liquid at least during operation of the X-ray tube, supplied thereto;

a vacuum vessel receiving said rotary anode, said rotor and a part of said stationary structure; and a heat transfer rod having a heat conductivity higher than that of the stationary structure inserted into the hole and tightly fitted in the hole to form an integral structure.

2. The X-ray tube according to claim 1, having a plurality of said holes and a plurality of said heat transfer members inserted into said holes, said holes having said heat transfer members inserted thereinto being formed to extend in parallel in the axial direction.

3. The X-ray tube according to claim 1, wherein said holes and said heat transfer members are substantially equidistantly arranged about the axis of said stationary structure.

4. The X-ray tube according to claim 1, wherein said stationary structure has a lubricant passageway extending laterally from said lubricant storage chamber so as to communicate with a bearing gap between said rotor and said stationary structure, and the hole and the heat transfer member extend beyond the lubricant passageway of the stationary structure so as to reach a region close to side edge portion of the rotary anode.

5. The X-ray tube according to claim 4, having a plurality of said holes and a plurality of said heat transfer members, some of said holes and respective heat transfer members extending beyond the lubricant passageway laterally extending within the stationary structure, and the other of said holes and respective heat transfer members not extending beyond the lubricant passageway.

6. An X-ray tube of a rotary anode type, comprising:

a disc-like rotary anode for emitting an X-ray upon irradiation with an electron beam;

a cylindrical rotor mechanically joined to said rotary anode;

a columnar stationary structure having an axis and one end, inserted into said rotor and provided with a lubricant storage chamber formed in said stationary structure along the axis thereof and a hole opened at the one end of the stationary structure and extending in said stationary structure from the one end of the stationary structure along the axis;

a slide bearing of a dynamic pressure type formed between the rotor and the stationary structure and having a metal lubricant, which is in the form of a liquid at least during operation of the X-ray tube, supplied thereto;

a vacuum vessel receiving said rotary anode, said rotor and a part of said stationary structure the one end of said stationary structure being located outside of said vacuum envelope; and a heat transfer rod having a heat conductivity higher than that of the stationary structure fitted into the hole and integrally bonded to the stationary structure.

7. The X-ray tube according to claim 6, having a lubricant passageway extending laterally from said lubricant storage chamber so as to communicate with the bearing gap between the rotor and the stationary structure.

8. The X-ray tube according to claim 6, wherein said stationary structure has a circular spiral groove therein for constituting a slide bearing of a dynamic pressure type on a plane perpendicular to the axis of said stationary structure and at least one lubricant passageway extending from said lubricant storage chamber so as to be open to the inner region or a part of the outer region of said circular spiral groove.

9. An X-ray tube of a rotary anode type, comprising:

a disc-like rotary anode for emitting an X-ray upon irradiation with an electron beam;

a cylindrical rotor mechanically joined to said rotary anode said rotor including an inner cylindrical structure and an outer cylindrical structure coaxially arranged around the inner cylinder;

a columnar stationary structure inserted into said rotor and having a lubricant storage chamber formed along the axis thereof;

a slide bearing of a dynamic pressure type formed between the inner cylindrical structure of said rotor and the stationary structure and having a metal lubricant, which is in the form of a liquid at least during operation of the X-ray tube, supplied thereto;

a vacuum vessel receiving said rotary anode, said rotor and a part of said stationary structure; and a heat transfer member having a heat conductivity higher than that of the inner cylindrical structure, arranged around the inner cylindrical structure in a cylindrical form and is bonded to the outer circumferential wall of the inner cylindrical structure.

10. The X-ray tube according to claim 9, wherein the various structures are arranged and configured so as to form a heat insulating clearance between the heat transfer member bonded to the outer circumferential wall of the inner cylindrical structure and the cylindrical structure arranged around the inner cylindrical structure and mechanically fixed to said rotary anode.

11. The X-ray tube according to claim 9, wherein the heat transfer member bonded to the outer circumferential wall of the inner cylindrical structure comprises a plurality of members arranged a predetermined distance apart from each other in the circumferential direction of the outer circumferential wall of said inner cylindrical structure.

12. An X-ray tube of a rotary anode type, comprising:

a disc-like rotary anode for emitting an X-ray upon irradiation with an electron beam;

a cylindrical rotor mechanically joined to said rotary anode ,said rotor including an inner cylindrical structure and an outer cylindrical structure coaxially arranged around the inner cylinder;

a columnar stationary structure having an axis and one end, inserted into said rotor and provided with a lubricant storage chamber formed in the stationary structure along the axis thereof, and a hole formed in said stationary structure and extending in said stationary structure from the one end of the stationary structure along the axis;

a slide bearing of a dynamic pressure type formed between the inner cylindrical structure of said rotor and the stationary structure and having a metal lubricant, which is in the form of a liquid at least during operation of the X-ray tube, supplied thereto;

a vacuum vessel receiving said rotary anode, said rotor and a part of said stationary structure, the one end of said stationary structure being located outside of said vacuum envelope; and a heat transfer rod having a heat conductivity higher than that of the stationary structure inserted into the hole and tightly fitted in the hole to form an integral structure with said stationary structure, a rotor formed of a plurality of cylindrical structures, and a heat transfer member having a heat conductivity higher than that of an inner cylindrical structure, arranged around the inner cylindrical structure in a cylindrical form and is bonded to the outer circumferential wall of the inner cylindrical structure.

13. The X-ray tube according to claim 12, wherein at least one heat transfer member for the stationary structure arranged in said stationary structure and the heat transfer member for the rotor arranged in the inner cylindrical structure of the rotor partially overlap with each other in the axial direction.

14. An X-ray tube of a rotary anode type, comprising:

a disc-like rotary anode for emitting an X-ray upon irradiation with an electron beam;

a cylindrical rotor mechanically joined to said rotary anode;

a columnar stationary structure inserted into the inner space of said rotor and having a lubricant storage chamber formed along the axis thereof said stationary structure including first and second portions integrally joined to each other, the first portion of a stationary structure formed of a predetermined first material, the second portion being positioned farther from the rotary anode than the first portion of the stationary structure and formed of a second material having a heat conductivity higher than that of the first material;

a slide bearing of a dynamic pressure type formed between the rotor and the first portion of said stationary structure and having a metal lubricant, which is in the form of a liquid at least during operation of the X-ray tube, supplied thereto; and a vacuum vessel having said rotary anode , said rotor and a part of said stationary structure housed therein;

wherein a first portion of a stationary structure in which a slide bearing of a dynamic pressure type is arranged is formed of a predetermined first material, a second portion positioned farther from the rotary anode than the first portion of the stationary structure is formed of a second material having a heat conductivity higher than that of the first material, and the first portion and the second potion are integrally joined to each other.

15. The X-ray tube according to claim 14, wherein said second portion has a hole therein arranged in a manner to extend upward from the edge surface and a heat transfer member having a heat conductivity higher than that of the material of the second portion is inserted into said hole.

* * * * *